US009747757B2

(12) United States Patent
Berman

(10) Patent No.: US 9,747,757 B2
(45) Date of Patent: Aug. 29, 2017

(54) GAMING DEVICE HAVING CONDITIONAL REEL FUNCTIONALITY

(71) Applicant: KING SHOW GAMES, INC., Minnetonka, MN (US)

(72) Inventor: Peter Berman, Minneapolis, MN (US)

( * ) Notice: Subject to any disclaimer, the term of this patent is extended or adjusted under 35 U.S.C. 154(b) by 146 days.

(21) Appl. No.: 14/677,371

(22) Filed: Apr. 2, 2015

(65) Prior Publication Data

US 2015/0287269 A1 Oct. 8, 2015

Related U.S. Application Data

(60) Provisional application No. 61/974,240, filed on Apr. 2, 2014.

(51) Int. Cl.
*G07F 17/32* (2006.01)
*G07F 17/34* (2006.01)

(52) U.S. Cl.
CPC ..... *G07F 17/34* (2013.01); *G07F 17/326* (2013.01)

(58) Field of Classification Search
None
See application file for complete search history.

(56) References Cited

U.S. PATENT DOCUMENTS 6,786,818 B1 * 9/2004 Rothschild ..... G07F 17/32 436/16
8,002,624 B2 8/2011 Paulsen et al.
8,057,305 B2 11/2011 Iverson et al.
8,075,389 B1 * 12/2011 Schultz ..... G07F 17/3244 463/16
8,277,308 B2 10/2012 Baerlocher et al.
8,313,369 B2 11/2012 Acres
8,371,929 B2 2/2013 Iverson et al.
8,388,432 B2 3/2013 Mattice et al.
8,469,797 B2 6/2013 Collette et al.
8,678,907 B2 3/2014 Pacey
9,022,852 B1 5/2015 Zoble et al.
9,251,668 B2 2/2016 Collette et al.
2006/0068893 A1 * 3/2006 Jaffe ..... G07F 17/34 463/20
2008/0176636 A1 * 7/2008 Nelson ..... G07F 17/34 463/20
2009/0104986 A1 * 4/2009 Englman ..... G07F 17/3258 463/27
2009/0111566 A1 * 4/2009 Naicker ..... G07F 17/32 463/20
2009/0124391 A1 * 5/2009 Nelson ..... G07F 17/3258 463/42

(Continued)

*Primary Examiner* — Jay Liddle
*Assistant Examiner* — Alex F. R. P. Rada, II

(57) ABSTRACT

Embodiments of the present invention set forth systems, apparatuses and methods for providing conditional reel functionality in gaming devices. Accordingly, a gaming device can be configured to increase the variety of outcomes and sense of anticipation in a video slot game, by varying the composition of symbols on one or more reels based on outcomes of previously determined reels. In some embodiments this varying of composition occurs while the reels are still spinning. The varying of composition may be accomplished by modifying, substituting, generating, or otherwise altering symbols or the order of symbols in the one or more reels.

20 Claims, 24 Drawing Sheets

(56) References Cited

U.S. PATENT DOCUMENTS

| | | | | |
|---|---|---|---|---|
| 2011/0021266 | A1* | 1/2011 | Jaffe | G07F 17/3258 463/25 |
| 2011/0070940 | A1* | 3/2011 | Jaffe | G07F 17/32 463/20 |
| 2014/0094248 | A1* | 4/2014 | Vancura | G07F 17/326 463/20 |
| 2014/0094270 | A1 | 4/2014 | Cuddy et al. | |
| 2015/0105138 | A1 | 4/2015 | Delekta et al. | |

* cited by examiner

GAMING DEVICE HAVING CONDITIONAL REEL FUNCTIONALITY

RELATED APPLICATIONS

This application claims the benefit of Provisional Patent Application No. 61/974,240, filed on Apr. 2, 2014, to which priority is claimed pursuant to 35 U.S.C. §119(e) and which is incorporated herein by reference in its entirety.

FIELD OF THE INVENTION

This disclosure relates generally to games, and more particularly to systems, apparatuses and methods for providing conditional reel functionality in gaming devices.

BACKGROUND

Casino games such as poker, slots, and craps have long been enjoyed as a means of entertainment. Some of these games originated using traditional elements such as playing cards or dice. More recently, gaming devices have been developed to simulate and/or further enhance these games while remaining entertaining. The popularity of casino gambling with wagering continues to increase, as does recreational gambling such as non-wagering computer game gambling. Part of this popularity is the increased development of new types of games that are implemented, at least in part, on gaming devices.

One reason that casino games are widely developed for gaming devices is that a wide variety of games can be implemented on gaming devices, thereby providing an array of choices for players looking to gamble. For example, the graphics and sounds included in such games can be modified to reflect popular subjects, such as movies and television shows. Game play rules and types of games can also vary greatly providing many different styles of gambling. Additionally, gaming devices require minimal supervision to operate on a casino floor, or in other gambling environments. That is, as compared to traditional casino games that require a dealer, banker, stickman, pit managers, etc., gaming devices need much less employee attention to operate.

With the ability to provide new content, players have come to expect the availability of an ever wider selection of new games when visiting casinos and other gaming venues. Playing new games adds to the excitement of "gaming." As is well known in the art and as used herein, the term "gaming" and "gaming devices" generally involves some form of wagering, and that players make wagers of value, whether actual currency or something else of value, e.g., token or credit. Wagering-type games usually provide rewards based on random chance as opposed to skill, although some skill may be an element in some types of games. Since random chance is a significant component of these games, they are sometimes referred to as "games of chance."

The present disclosure describes methods, systems, and apparatus that provide for new and interesting gaming experiences, and that provide other advantages over the prior art.

SUMMARY

To overcome limitations in the prior art described above, and to overcome other limitations that will become apparent upon reading and understanding the present specification, embodiments of the present invention are directed to an apparatus, system, computer readable storage media, and/or method that involve or otherwise facilitate conditional reel functionality for gaming devices.

In some embodiments, the conditional reel functionality uses characteristics of a determined outcome on a first game reel to conditionally modify an aspect of a second game reel during a gaming event. This conditional modification may be based on one or more trigger criteria being satisfied by the characteristics of the determined outcome on the first game reel and/or by other predefined elements being associated with the gaming event. Additionally, this determination process may be done iteratively for multiple reels. That is, for example, an outcome characteristic of a first reel may be used to determine an aspect of a second reel. In turn, an outcome characteristic of the second reel may be used to determine an aspect of a third reel. This iterative process may be repeated for some or all of the reels in a gaming device.

In various embodiments, the modified aspect of the second reel (and other reels, respectively) may include substituting another predetermined reel strip prior to an outcome being determined or shown, modifying one or more symbol locations on an existing reel strip, dynamically generating a new reel strip, or otherwise modifying the composition of symbols on the reel strip.

In other embodiments, even the first reel strip may be selected, conditionally modified, or dynamically generated prior to an outcome being determined or shown. Here, the conditional modification may be related to game play attributes, player characteristics, wager type or amount, or other measurable conditions.

In one example embodiment, a gaming device includes a game display showing sections of multiple game reels, a memory storing at least one combination of symbols for each of the multiple game reels, and a processor. The processor is configured to receive a wager, randomly determine an outcome position for a first portion of the multiple game reels, and evaluate the symbols associated with the outcome positions for the first portion of game reels to determine if a predefined condition has been satisfied. When the predefined condition has been satisfied, the processor is further configured to alter the symbol combination of at least one of a second portion of the game reels prior to displaying outcome positions of the second portion of game reels on the game display.

In another example embodiment, a gaming device includes a game display showing sections of multiple game reels, a memory storing at least one combination of symbols for a first game reel and a data structure containing symbol data, and a processor. The processor is configured to receive a wager, randomly determine an outcome position for a first reel of the multiple game reels, and evaluate the symbols associated with the outcome positions for the first reel. The processor is further configured to dynamically generate a second reel strip associated with a second reel from the symbol data stored in the memory based on the determined outcome position for the first reel, and to determine an outcome position for the second reel from the dynamically generated second reel strip.

DETAILED DESCRIPTION

Figure 1:
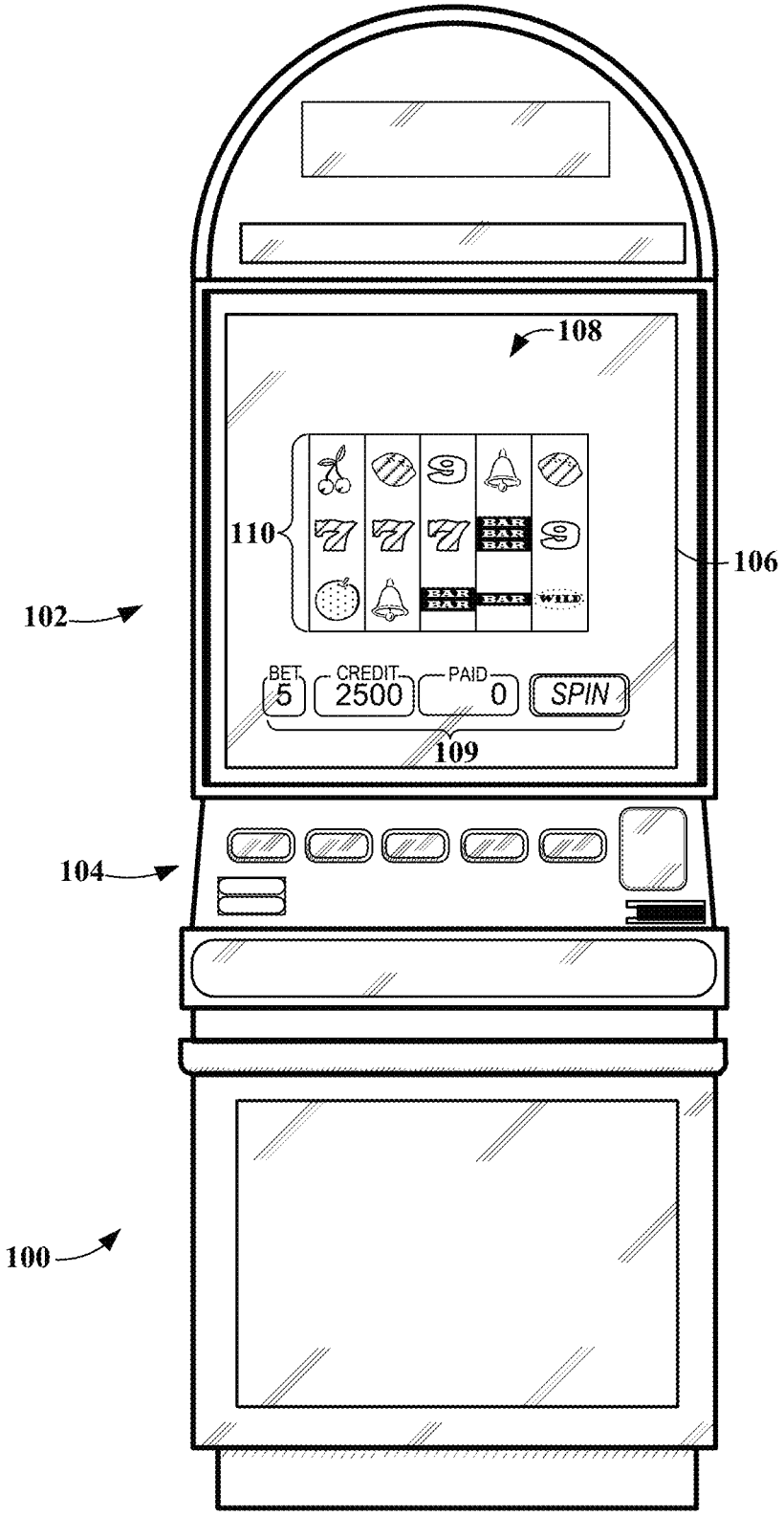
FIG. 1 is a diagram of a gaming machine according to embodiments of the invention.

In the following description of various exemplary embodiments, reference is made to the accompanying drawings which form a part hereof, and in which is shown by way of illustration representative embodiments in which the features described herein may be practiced. It is to be understood that other embodiments may be utilized, as structural and operational changes may be made without departing from the scope of the disclosure.

In the description that follows, the terms "reels," "cards," "decks," and similar mechanically descriptive language may be used to describe various apparatus presentation features, as well as various actions occurring to those objects (e.g., "spin," "draw," "hold," "bet"). Although the present disclosure may be applicable to manual, mechanical, and/or computerized embodiments, as well as any combination therebetween, the use of mechanically descriptive terms is not meant to be only applicable to mechanical embodiments. Those skilled in the art will understand that, for purposes of providing gaming experiences to players, mechanical elements such as cards, reels, and the like may be simulated on a display in order to provide a familiar and satisfying experience that emulates the behavior of mechanical objects, as well as emulating actions that occur in the non-computerized games (e.g., spinning, holding, drawing, betting). Further, the computerized version may provide the look of mechanical equivalents but may be generally randomized in a different way. Thus, the terms "cards," "decks," "reels," "hands," etc., are intended to describe both physical objects and emulation or simulations of those objects and their behaviors using electronic apparatus.

In various embodiments of the invention, the gaming displays are described in conjunction with the use of data in the form of "symbols." In the context of this disclosure, a "symbol" may generally refer at least to a collection of one or more arbitrary indicia or signs that have some conventional significance. In particular, the symbol represents values that can at least be used to determine whether to award a payout. A symbol may include numbers, letters, shapes, pictures, textures, colors, sounds, etc., and any combination therebetween. A win can be determined by comparing the symbol with another symbol. Generally, such comparisons can be performed via software by mapping numbers (or other data structures such as character strings) to the symbols and performing the comparisons on the numbers/data structures. Other conventions associated with known games (e.g., the numerical value/ordering of face cards and aces in card games) may also be programmatically analyzed to determine winning combinations.

Generally, systems, apparatuses and methods are described for enhancing winning result opportunities in gaming activities. The systems, apparatuses and methods described herein may be implemented as a single game, or part of a multi-part game. For example, the game features described herein may be implemented in primary gaming activities, bonus games, side bet games or other secondary games associated with a primary gaming activity. The game features may be implemented in stand-alone games, multi-player games, etc. Further, the disclosure may be applied to games of chance, and descriptions provided in the context of any representative game (e.g. video slot machine) are provided for purposes of facilitating an understanding of the features described herein. However, the principles described herein are equally applicable to any game of chance where an outcome(s) is determined for use in the player's gaming activity. The game features described herein may be employed in stand-alone games, primary/base games, bonus games, side bet games, etc.

Numerous variations are possible using these and other embodiments of the inventive concept. Some of these embodiments and variations are discussed below with reference to the drawings. However, many other embodiments and variations exist that are covered by the principles and scope of this concept. For example, although some of the embodiments discussed below involve reel-based slot machine examples of this concept, other embodiments include application of these inventive techniques in other types of slot games, poker games, or other games of chance. Some of these other types of embodiments will be discussed below as variations to the examples illustrated. However, many other types of games can implement similar techniques and fall within the scope of this inventive concept.

Referring to the example gaming apparatus 100 shown in FIG. 1, the gaming apparatus includes a display area 102 (also referred to as a gaming display), and a player interface area 104, although some or all of the interactive mechanisms included in the user interface area 104 may be provided via graphical icons used with a touch screen in the display area 102 in some embodiments. The display area 102 may include one or more game displays 106 (also referred to as "displays" or "gaming displays") that may be included in physically separate displays or as portions of a common large display. Here, the game display 106 includes a primary game play portion 108 that displays game elements and symbols 110 and an operations portion 109 that can include meters, various game buttons, or other game information for a player of the gaming device 100.

The user interface 104 allows the user to control and engage in play of the gaming machine 100. The particular user interface mechanisms included with user interface 104 may be dependent on the type of gaming device. For example, the user interface 104 may include one or more buttons, switches, joysticks, levers, pull-down handles, trackballs, voice-activated input, or any other user input system or mechanism that allows the user to play the particular gaming activity.

The user interface 104 may allow the user or player to enter coins, bills, or otherwise obtain credits through vouchers, tokens, credit cards, tickets, etc. Various mechanisms for entering such vouchers, tokens, credit cards, coins, tickets, etc. are known in the art. For example, coin/symbol input mechanisms, card readers, credit card readers, smart card readers, punch card readers, radio frequency identifier (RFID) readers, and other mechanisms may be used to enter wagers. It is through the user interface 104 that the player can initiate and engage in gaming activities. While the illustrated embodiment depicts various buttons for the user interface 104, it should be recognized that a wide variety of user interface options are available for use in connection with the present invention, including pressing buttons, touching a segment of a touch-screen, entering text, entering voice commands, or other known data entry methodology.

The game display 106 in the display area 102 may include one or more of an electronic display, a video display, a mechanical display, and fixed display information, such as paytable information associated with a glass/plastic panel on the gaming machine 100 and/or graphical images. The symbols or other indicia associated with the play of the game may be presented on an electronic display device or on mechanical devices associated with a mechanical display. Generally, the display 106 devotes the largest portion of viewable area to the primary gaming portion 108. The primary gaming portion 108 is generally where the visual feedback for any selected game is provided to the user. The primary gaming portion 108 may render graphical objects such as cards, slot reels, dice, animated characters, and any other gaming visual known in the art. The primary gaming portion 108 also typically informs players of the outcome of any particular event, including whether the event resulted in a win or loss.

In some the example embodiments illustrated herein, the primary gaming portion 108 may display a grid (or equivalent arrangement) of game elements 110 or game element positions (also referred to as "reel stop positions" herein). As illustrated in the embodiment shown in FIG. 1, the grid includes three rows and five columns of game elements 110, which may form a game outcome of a game play event from which prizes are determined. In some slot machine examples, each column may display a portion of a game reel. The game reels may include a combination of game symbols in a predefined order. In mechanical examples, the game reels may include physical reel strips where game symbols are shown in images fixed on the reel strips. Virtual reel strips may be mapped to these physical reel positions shown on the reel strips to expand the range or diversity of game outcomes. In video slot examples, reel strips may be encoded in a memory or database and virtual reels may be used for the game reels with images representing the data related to the reel strips. In other slot machine embodiments, each reel stop position on the grid may be associated with an independent reel strip. In yet other slot machine embodiments, reels and/or reel strips may not be used at all in determining the symbols shown in the game element positions of the grid. For example, a symbol may be randomly selected for each game element position, or the symbols may be determined in part by game events occurring during game play, such as displayed elements being replaced by new game elements or symbols. Numerous variations are possible for implementing slot-type game play.

The primary gaming portion 108 may include other features known in the art that facilitate gaming, such as status and control portion 109. As is generally known in the art, this portion 109 provides information about current bets, current wins, remaining credits, etc. associated with gaming activities of the grid of game elements 110. The control portion 109 may also provide touchscreen controls for facilitating game play. The grid of game elements 110 may also include touchscreen features, such as facilitating selection of individual symbols, or user controls over stopping or spinning reels. The game display 106 of the display area 102 may include other features that are not shown, such as paytables, navigation controls, etc.

Embodiments of the present invention provide a method to increase the variety of outcomes and sense of anticipation in a video slot game, by varying the composition of symbols on one or more reels based on outcomes of previously determined reels. In some embodiments this varying of composition occurs while the reels are still spinning. The varying of composition may be accomplished by modifying, substituting, generating, or otherwise altering symbols or the order of symbols in the one or more reels.

In one embodiment having a game with this type of feature, after the reels start spinning, some reels stop spinning before others do. The feature is initiated by one or more visible symbols, overlays, or other elements appearing on or around the first reel(s) that stop spinning. Upon initiation, which may be accompanied by a presentation involving graphics and/or sound, the symbols on one or more of the still-spinning reels change. In some embodiments, one or more new reel strips are substituted for the existing reel strips on the spinning reels. In some embodiments, two or more of the spinning reels are locked together, so that symbols on the locked reels are paired. Typically, the change results in an increased likelihood of pays or awards occurring and/or of higher pay amounts being awarded. In some embodiments, the feature may be reinitiated one or more times in the same game.

In some embodiments, a video slot game is designed so that the sequence in which the reels stop spinning must fit into one or more predetermined patterns. This sequence could start the same way in every game (e.g., "Reel 1 is the first reel to stop spinning in every game") or in one of several different ways (e.g., "Depending on the outcome of a random lookup, either (i) Reel 1 or (ii) Reel 4 or (iii) Reels 5 and 6 together are the first to stop spinning"). Each time a reel or set of reels stop spinning, the processor or computer system evaluates the symbols that are visible on the reel(s), determining whether the symbols fit one or more predetermined combinations. Depending on the outcome of this evaluation, the system may change one or more of the reels still spinning, by changing the reel strips and/or by locking reels; the system may also use the outcome of the evaluation to determine which reel(s) will be next to stop spinning. If the reels are changed, then the system may present the change via some type of exciting animation and sound (e.g., an explosion is shown; when the smoke clears, the new symbols are shown spinning). In some instances, the appearance of the new symbols may be different from the originals (e.g., different color background, or symbols grouped into a block or other shape). The process may be repeated as long as there are two or more reels still spinning. The process need not start with the first set of reel or reels that stop spinning. The triggering symbol combination could be very broadly defined, e.g. "Reels 1 and 2 are such that no payline pay is possible"—in which case new reel strips could be substituted in that provide anticipation for some other type of pay or feature (see example below).

FIGS. 2A-2H and 3A-3G are diagrams of a game display showing example game progression embodiments using conditional reel functionality. These example game progressions and illustrated to show of the possible embodiments using concepts of this invention, but are not meant to be complete or limiting in any manner. Rather, many different variations and other embodiments are possible; some of which are described in detail below.

Referring to FIGS. 2A-2H, a game display 200 includes a game or display grid 210 showing portions of five game reels 211, 212, 213, 214, 215, an indicator grid 230 showing corresponding indicator positions 231, 232, 233, 234, 235, a "Total Bet" meter 256 showing an amount wagered on a gaming event, a "Paid" meter 258 showing an amount won in gaming event, and a "SPIN" button 250 that allows a player to activate a gaming event.

Figure 2A:
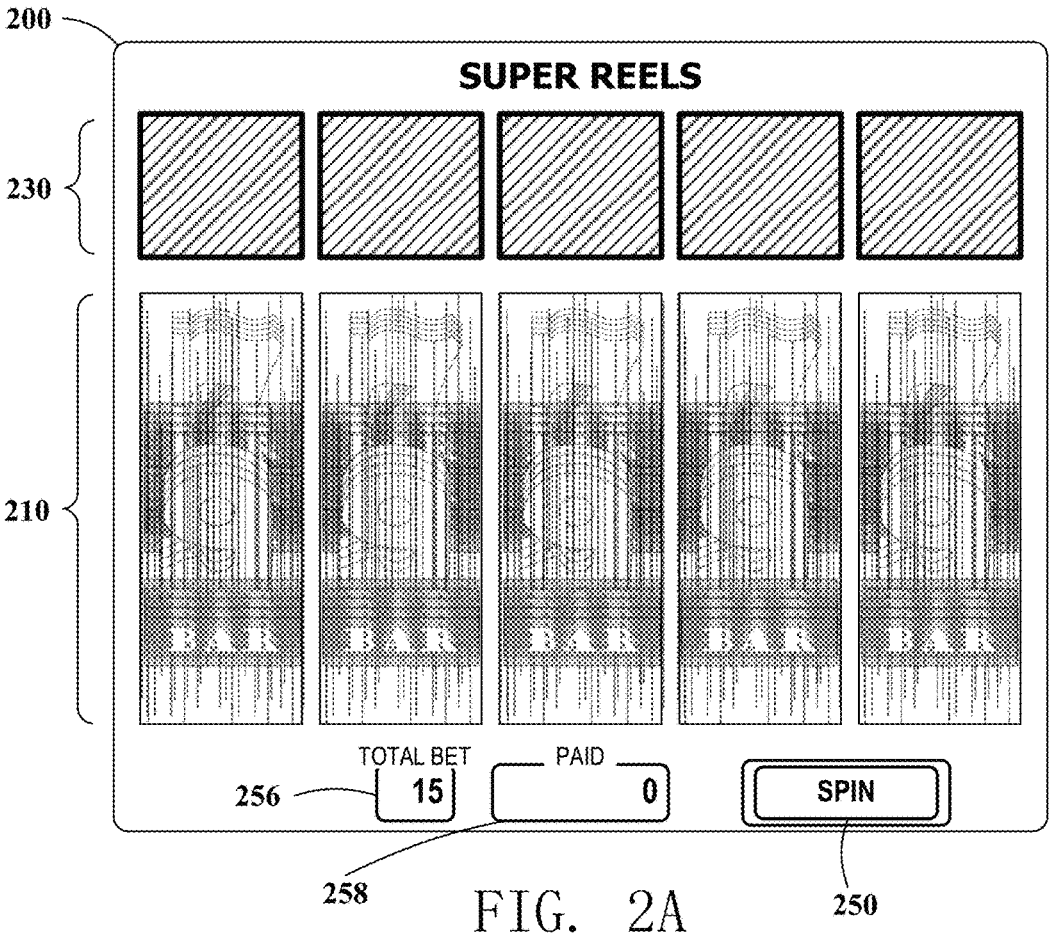
FIGS. 2A, 2B, 2C, 2D, 2E, 2F, 2G, and 2H are diagrams of a game display showing a game progression using conditional reel functionality according to embodiments of the invention.
Figure 2B:
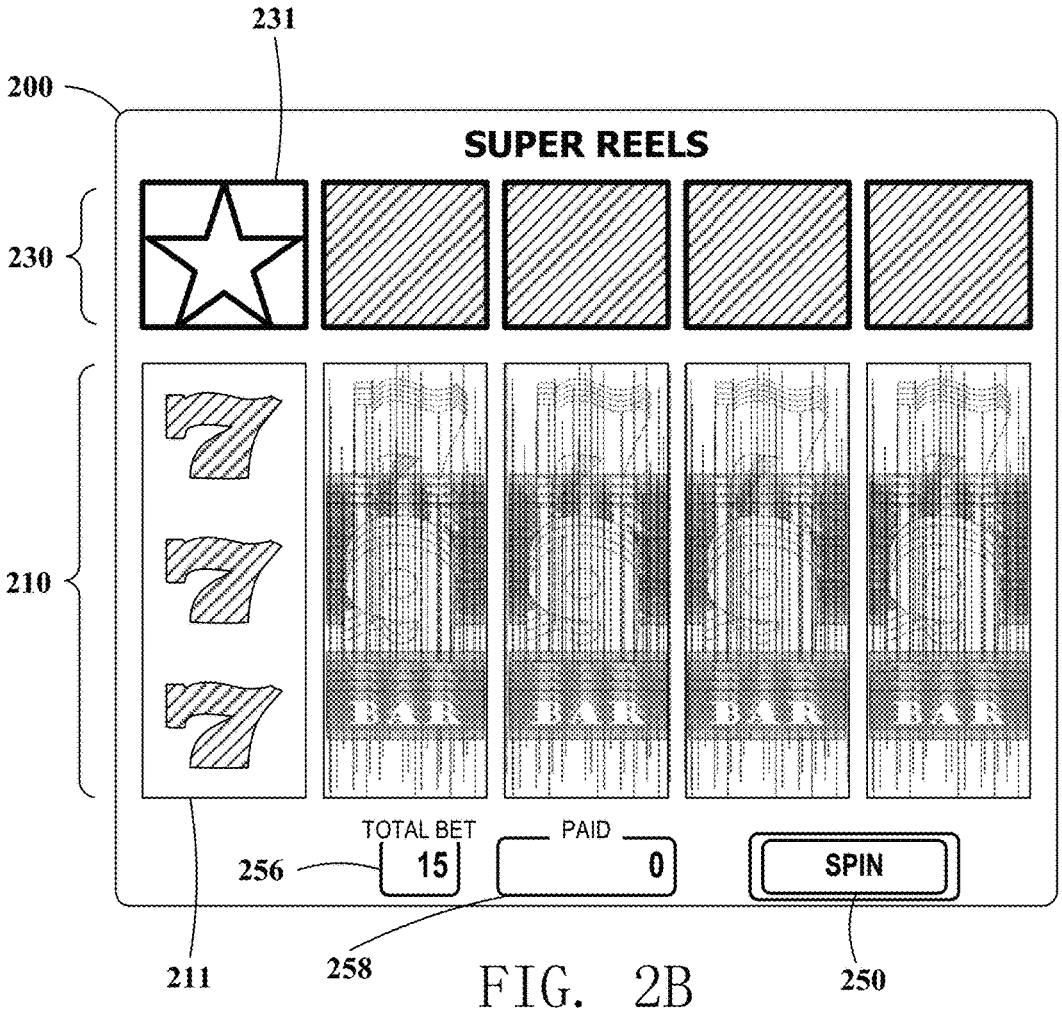
Figure 2C:
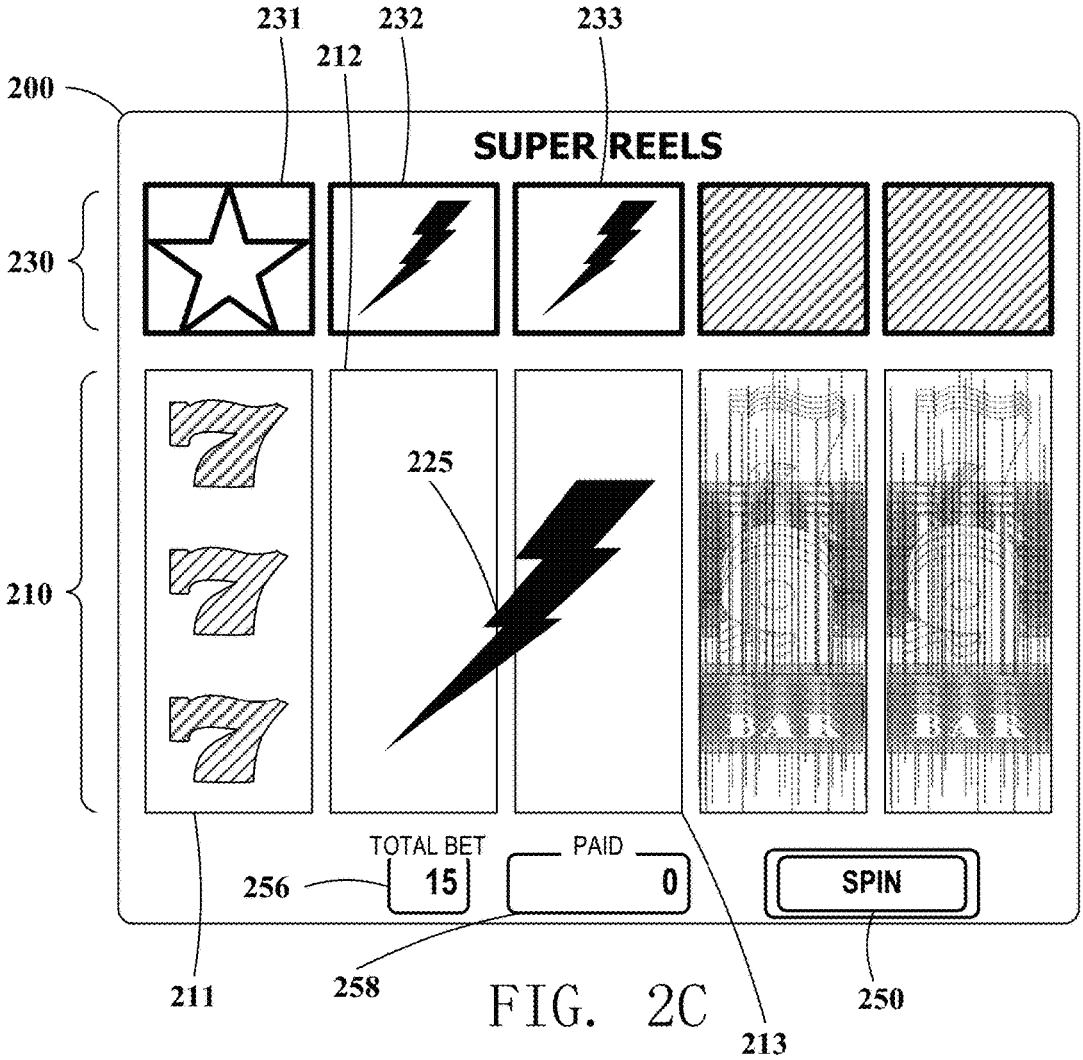

In FIG. 2A, a game event has been activated and each of the five reels are spinning through the game grid 210. In FIG. 2B, the first reel 211 comes to a stop showing a determined outcome for the first reel, which appears in the game grid 210. Here, the stack of "Shaded 7" symbols in the first reel 211 is a triggering event causing a special "star" symbol to appear in the first indicator position 231. This triggering event causes a presentation animation 225 to appear over the second reel 212 and third reel 213 while also causing a trigger symbol to appear in the second indicator position 232 and the third indicator position 233, as shown in FIG. 2C.

Figure 2D:
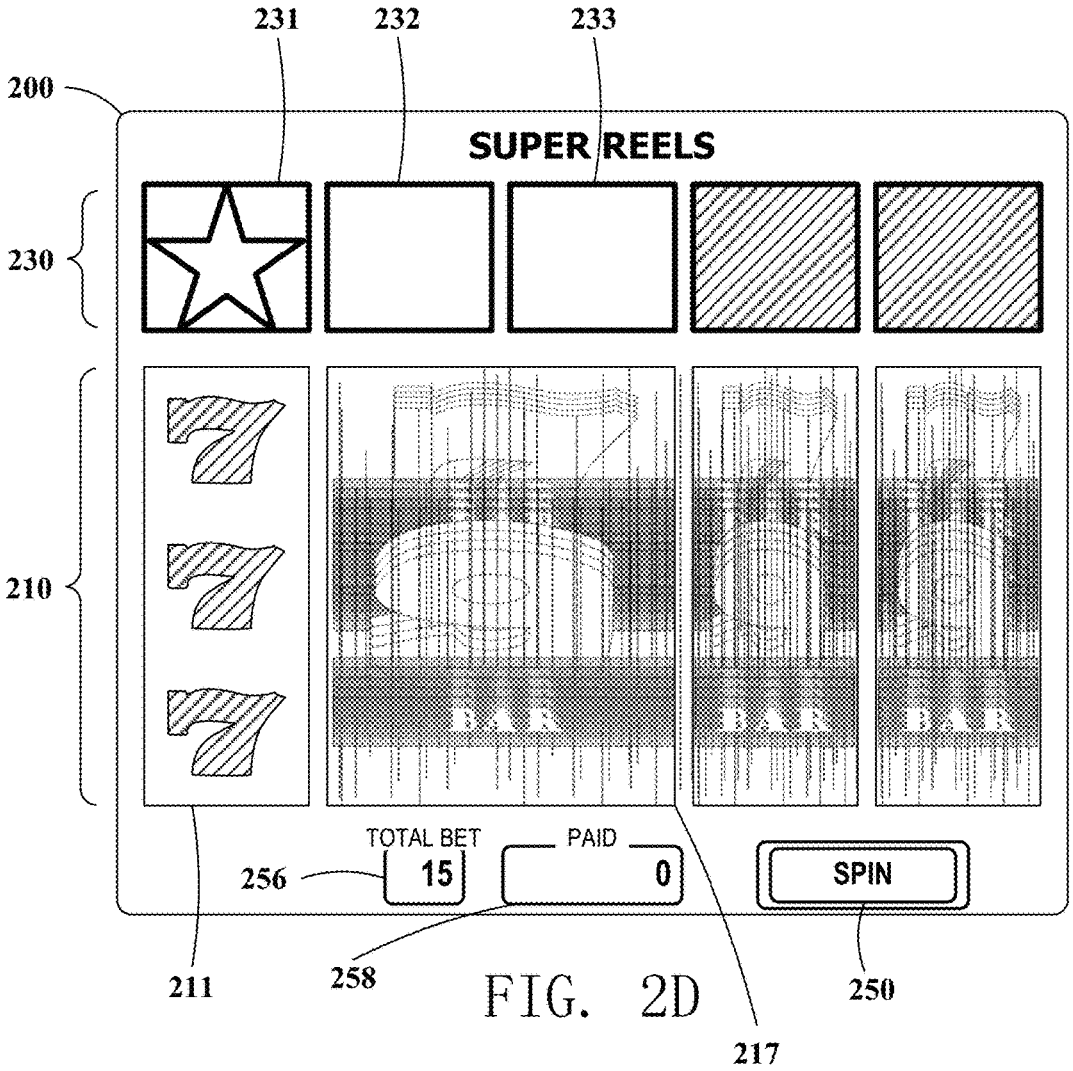
Figure 2E:
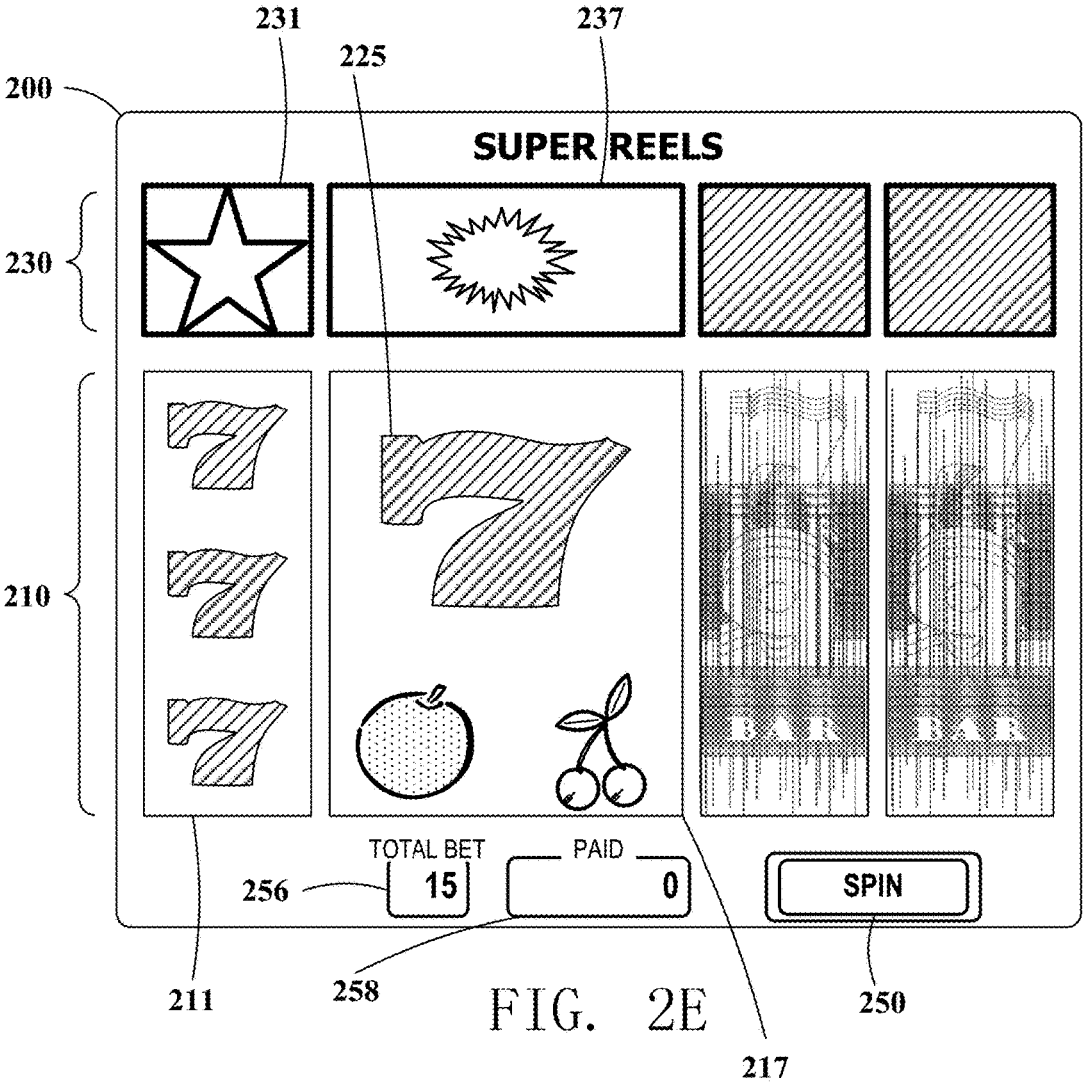

After the presentation animation, the second reel 212 and third reel 213 are locked together 217 with a new set of reel strips "swapped in" in mid-spin as shown in FIG. 2D. These new reel strips are tailored to match the pattern shown in the first reel 211 based on the triggering event. In this embodiment, since a stack of "Shaded 7" symbols are shown in the first reel 211, the new reel strips include a block "Shaded 7" symbol that covers the locked second and third reel 217. The locked second and third reel 217 stops spinning in FIG. 2E revealing a 2×2 block of symbols 225 that substitute for the "shaded 7" symbol that is stacked on the first reel 211.

Figure 2F:
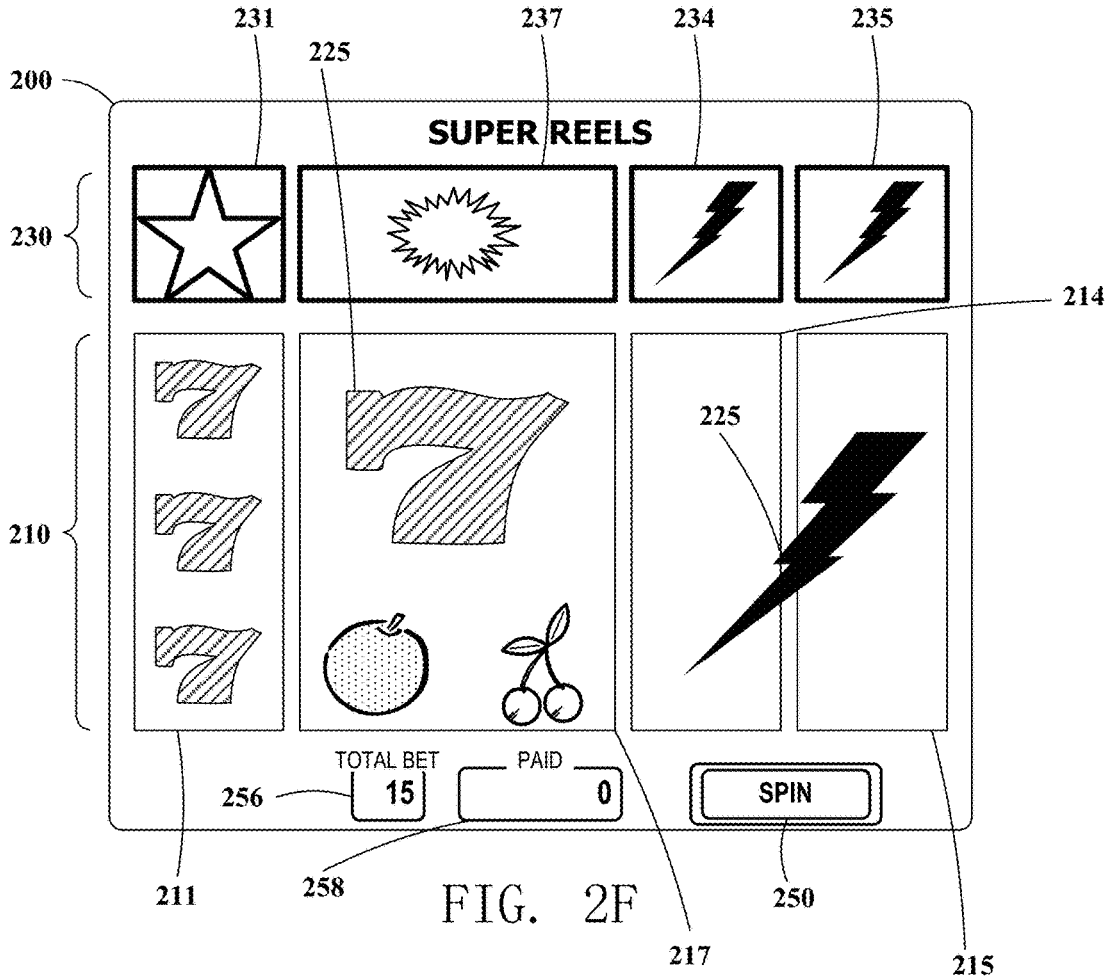
Figure 2G:
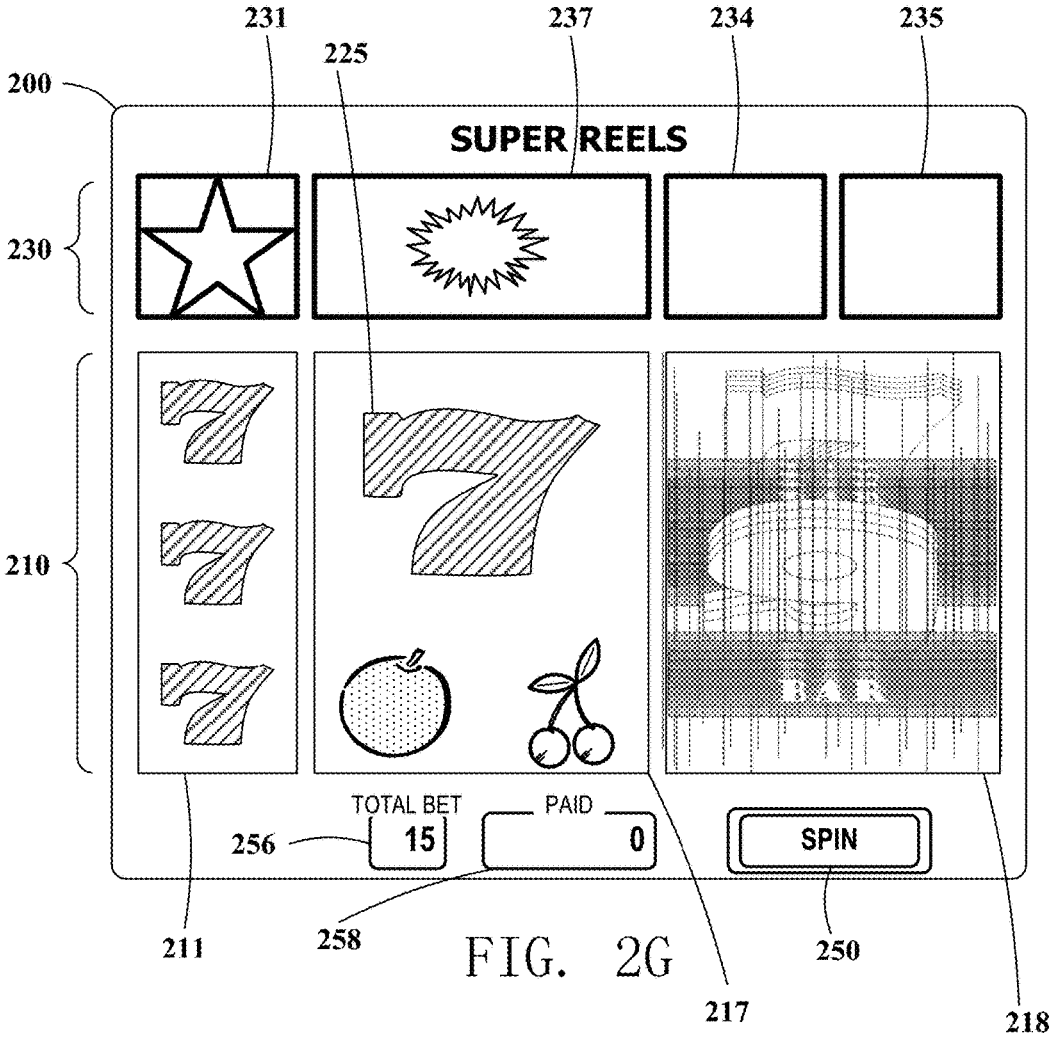
Figure 2H:
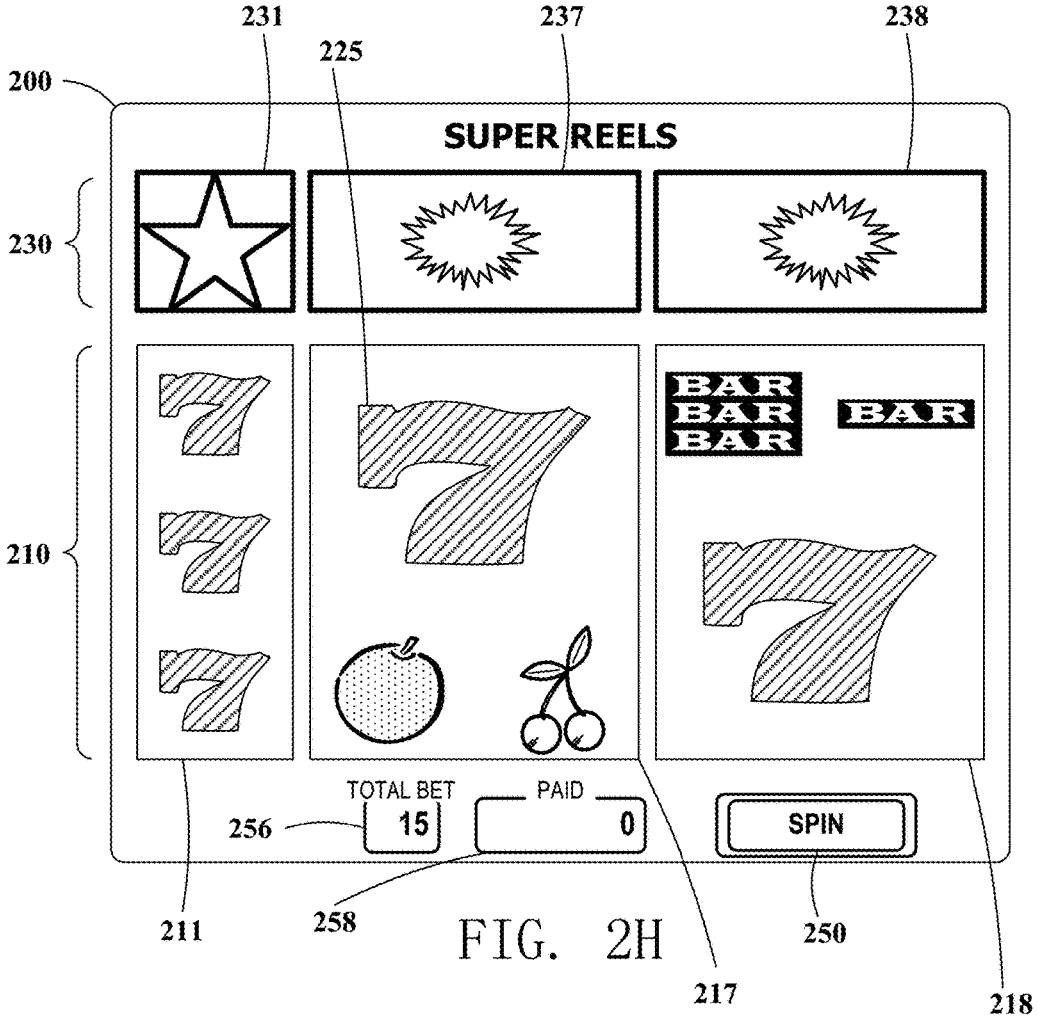

Since the 2×2 block symbol 225 appears on the locked second and third reel 217, this triggers another special indicator icon to appear in the locked second and third indicator position 237, and another special presentation animation 225 over the fourth reel 214 and the fifth reel 215, as shown in FIG. 2F. In addition, presentation animations are shown in the fourth indicator position 234 and the fifth indicator position 235. The fourth reel and fifth reel are now locked together 218 with a new set of reel strips "swapped in" in mid-spin as shown in FIG. 2G. These new reel strips are tailored to match the pattern shown in the locked second and third reel 217 based on the triggering event.

After the locked fourth and fifth reel 218 stop spinning, and the fourth and fifth indicator positions are locked 238, the resulting game grid 210 is evaluated for winning symbol combinations. Here, each of the 2×2 blocks of symbols 225 are evaluated as individual symbols in each grid position of the game grid 210. Hence, 3 symbol, 4 symbol, and 5 symbol pays of symbol combinations involving the "Shaded 7" symbols are made.

Referring to FIGS. 3A-3G, a game display 300 includes a game or display grid 310 showing portions of five game reels 311, 312, 313, 314, 315, an indicator grid 330 showing corresponding indicator positions 331, 332, 333, 334, 335, a "Total Bet" meter 356 showing an amount wagered on a gaming event, a "Paid" meter 358 showing an amount won in gaming event, and a "SPIN" button 350 that allows a player to activate a gaming event.

Figure 3A:
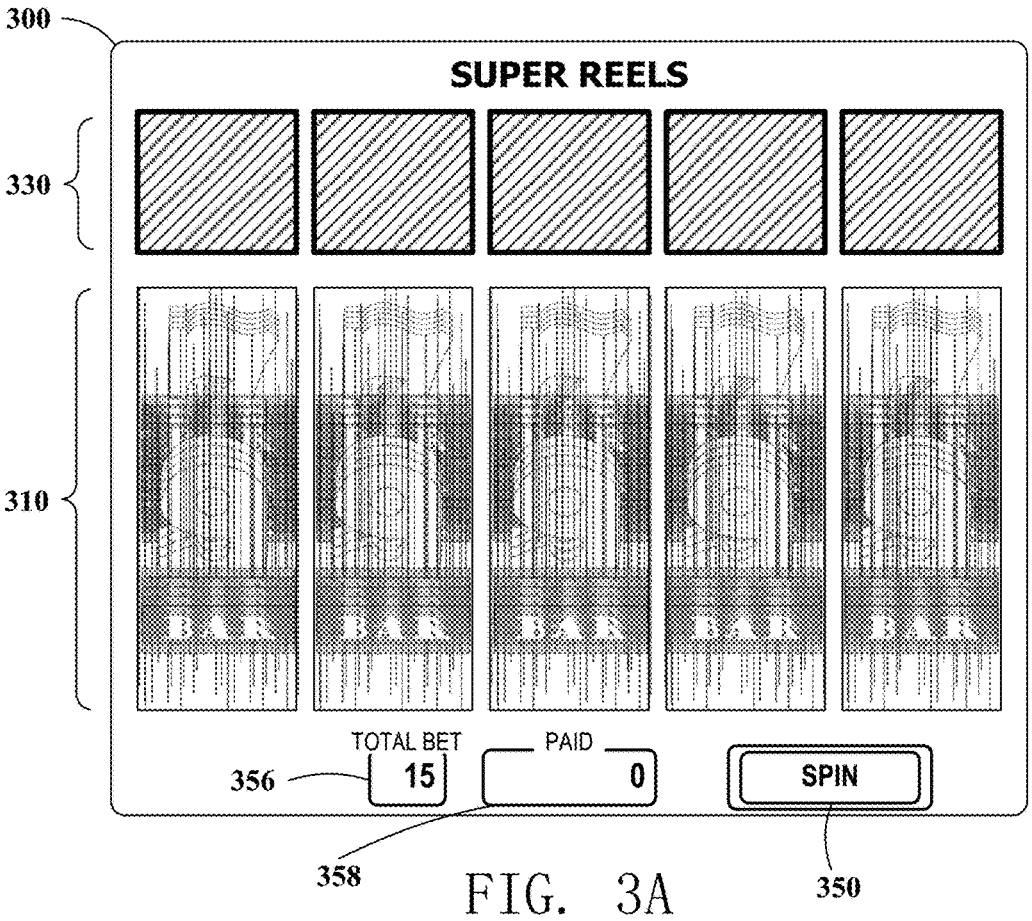
FIGS. 3A, 3B, 3C, 3D, 3E, 3F, and 3G are diagrams of a game display showing another game progression using conditional reel functionality according to embodiments of the invention.
Figure 3B:
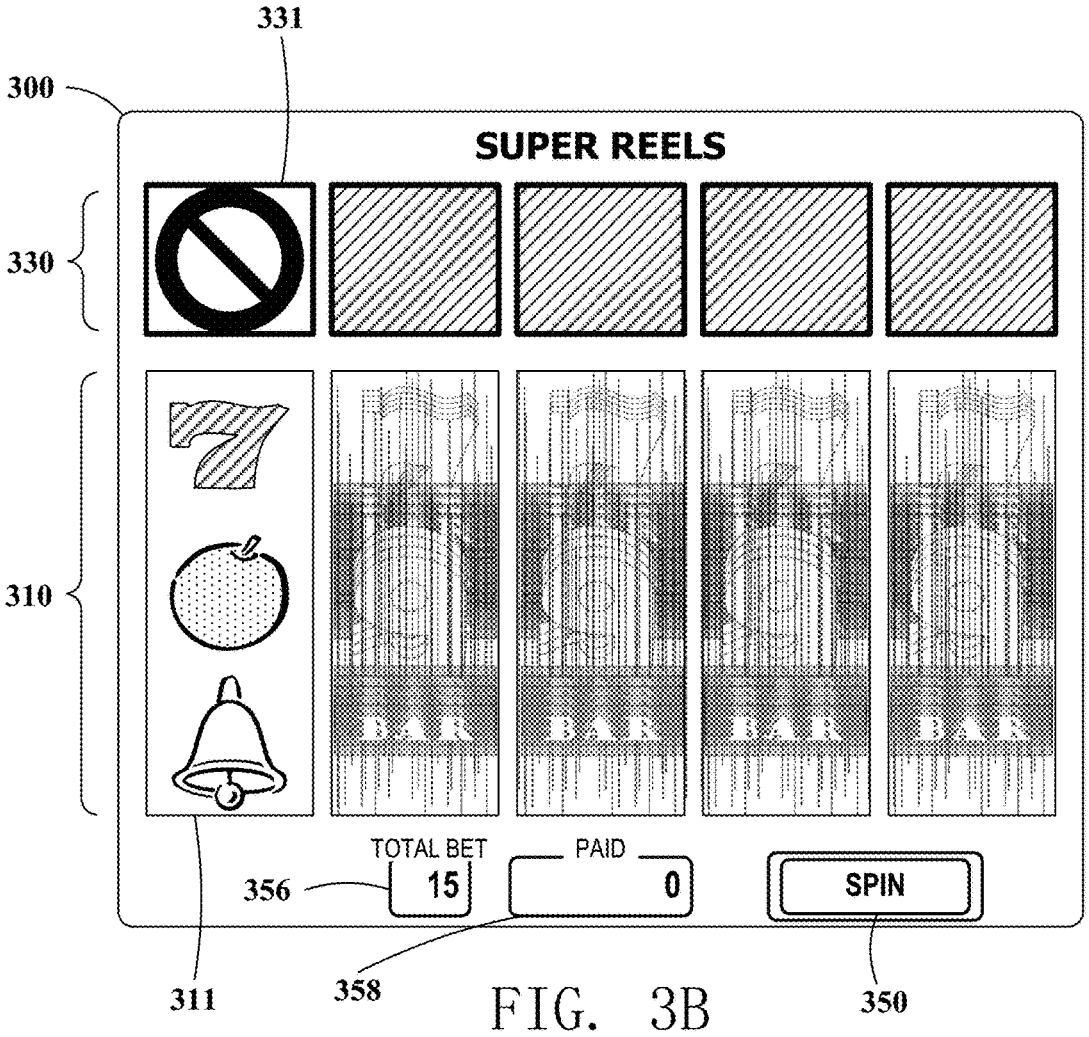
Figure 3C:
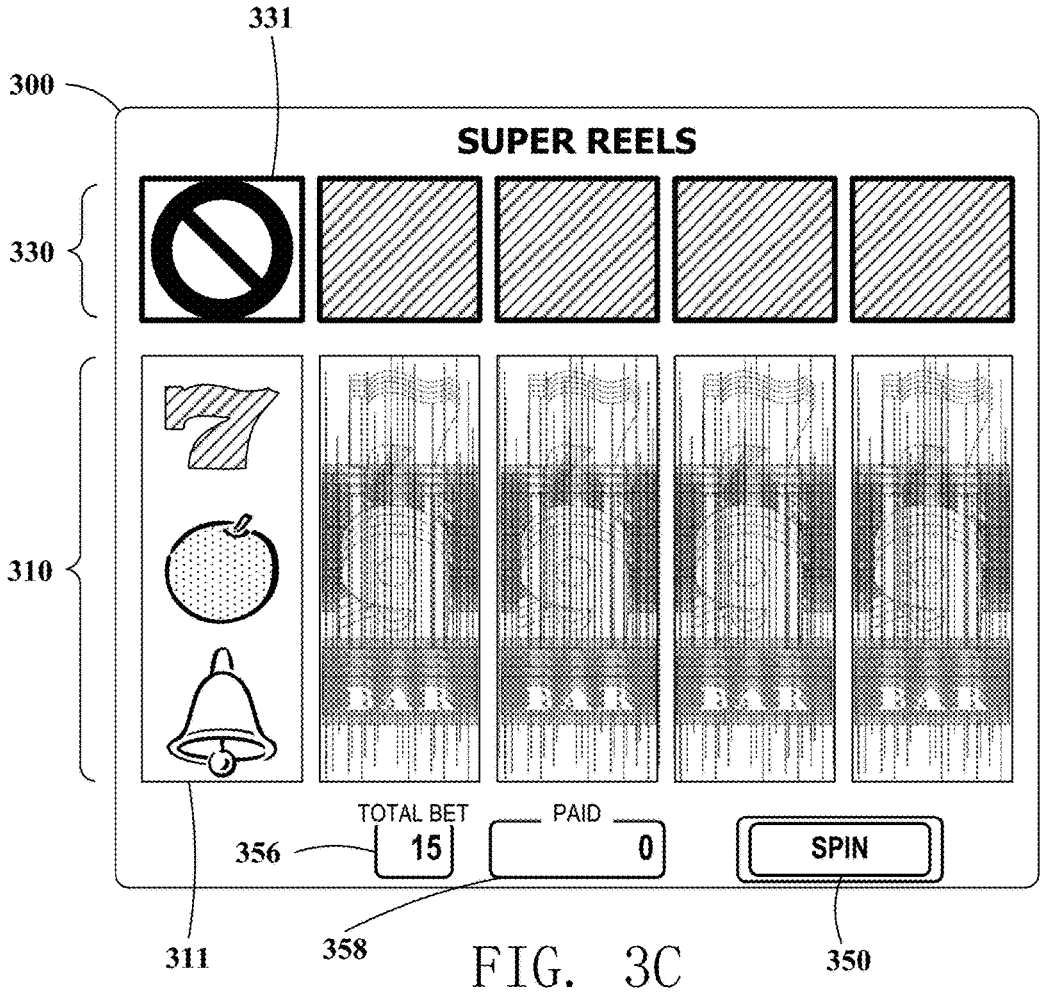
Figure 3D:
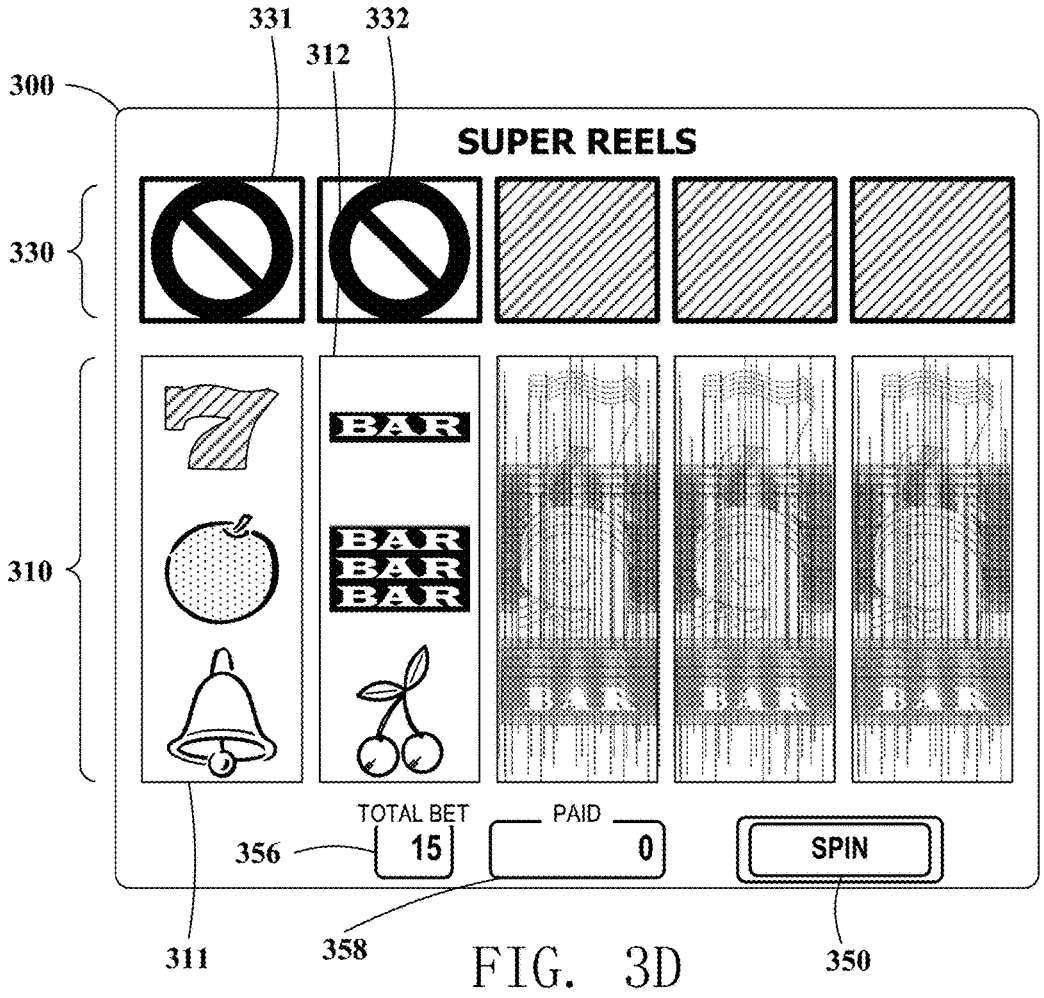

In FIG. 3A, a game event has been activated and each of the five reels are spinning through the game grid 310. In FIG. 3B, the first reel 311 comes to a stop showing a determined outcome for the first reel, which appears in the game grid 310. Here, the group of symbols on the first reel 311 is not a triggering event (e.g., they do not match any special predefined pattern). Hence, a "no pattern" or strike symbol is shown in the first indicator position 331. The remaining reels 312, 313, 314, 315 continue to spin like normal as shown in FIG. 3C. In FIG. 3D, the second reel 312 stops, which again does not show a triggering event or pattern. Hence, another "no pattern" or strike symbol is placed in the second indicator position 332 of the indicator grid 330. Since the symbols shown on the first reel 311 and second reel 312 do not match at all, there are no possible payline pays for the game since it only pays left to right.

Figure 3E:
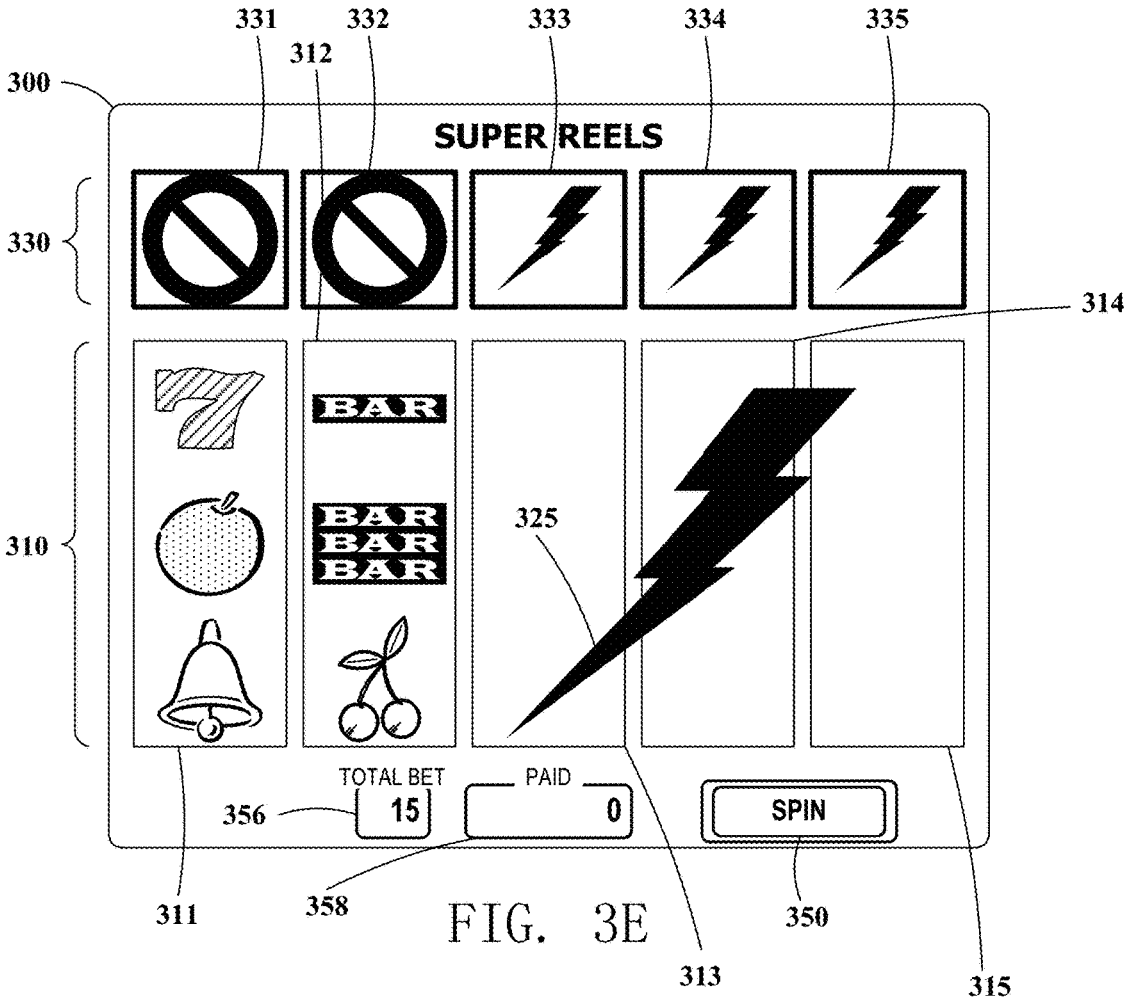
Figure 3F:
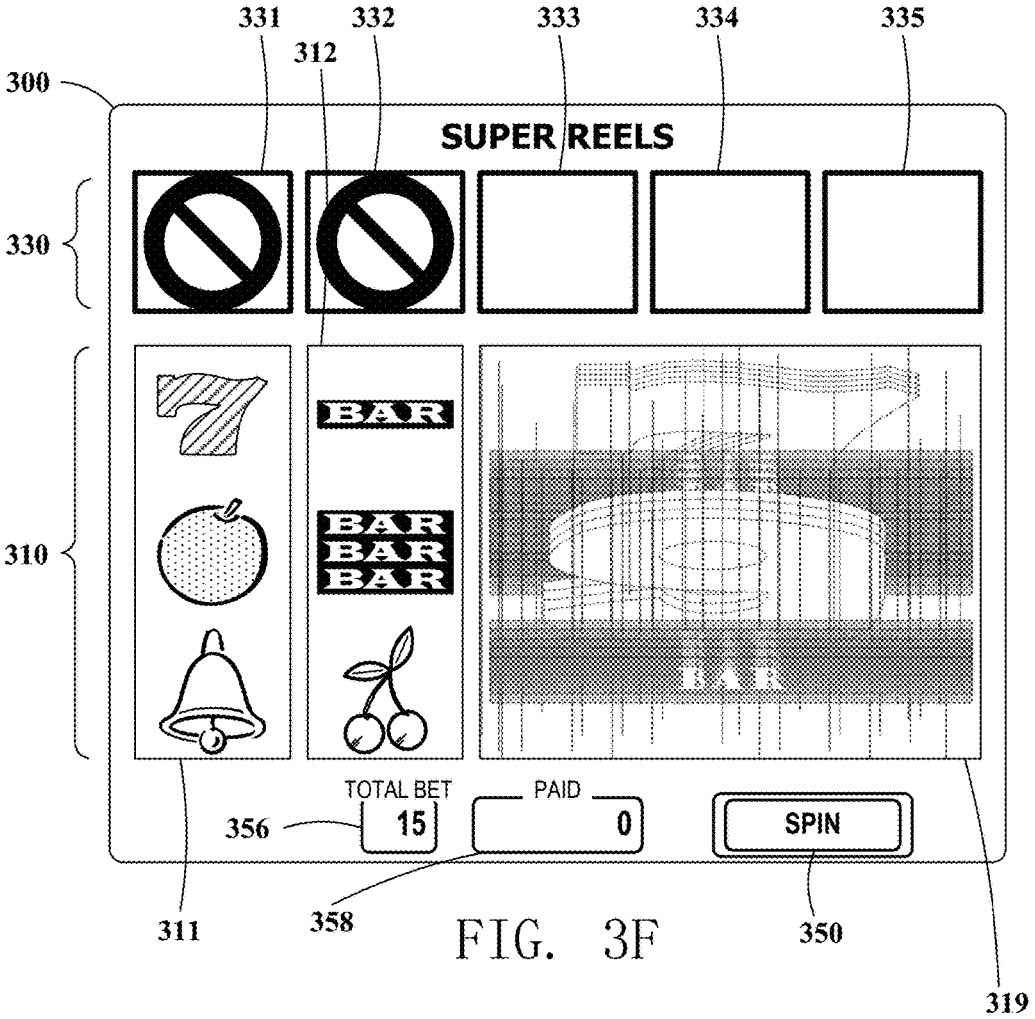

However, in this embodiment, the impossibility of a line pay triggers a presentation animation 325 over the third reel 313, the fourth reel 314, and the fifth reel 315, as well as in the third indicator position 333, the fourth indicator position 334, and the fifth indicator position 335, as shown in FIG. 3E. After this presentation animation 325, the third reel 313, the fourth reel 314, and the fifth reel 315 are locked together 319 with a new set of reel strips "swapped in" in mid-spin, as shown in FIG. 3F. These new reel strips include 3×3 blocks of symbols that may trigger a bonus or other pay despite the impossibility of a line win.

Figure 3G:
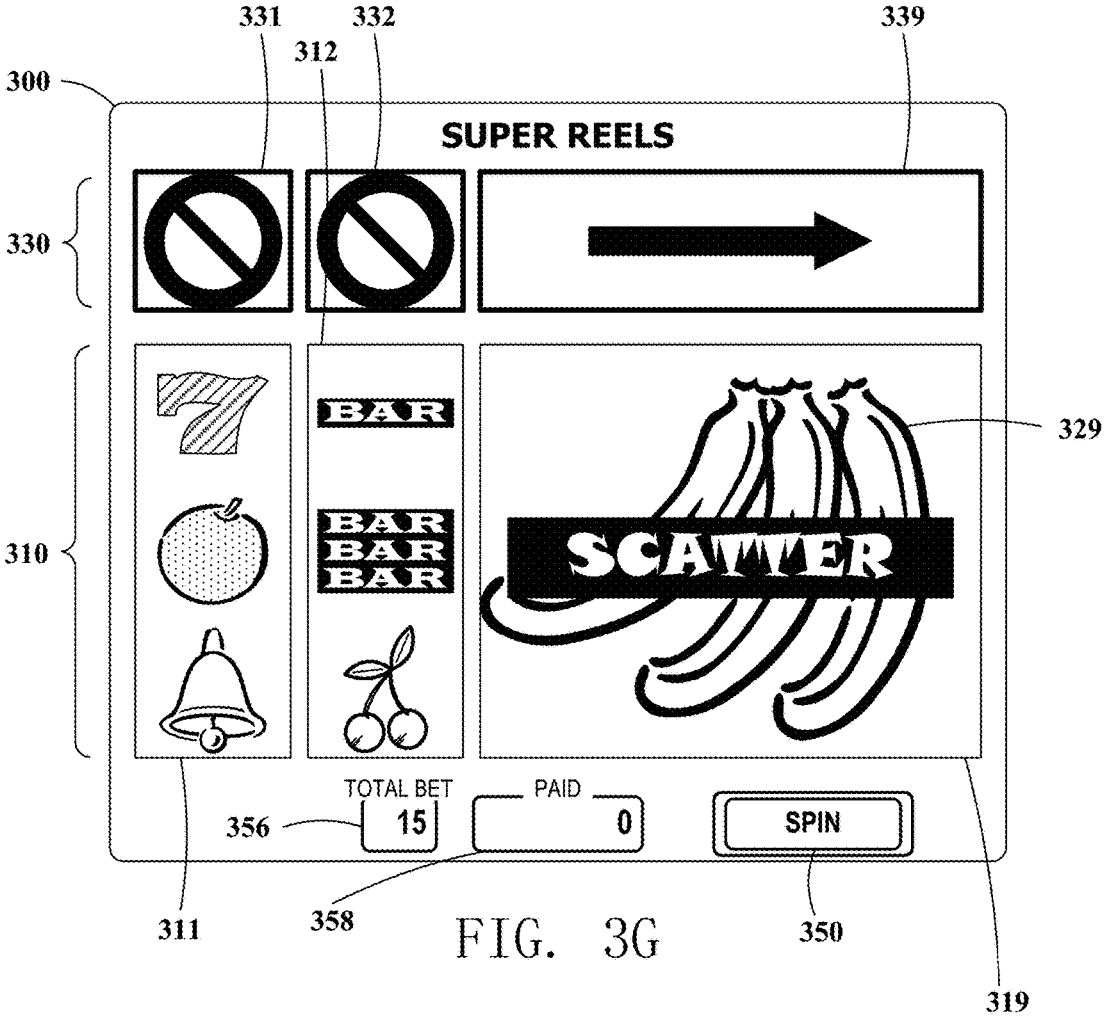

In FIG. 3G, this locked reel 319 stops spinning indicating a 3×3 block of scatter symbols 329. Hence, a 9-symbol scatter pay is won when the game grid 310 is evaluated for awards. In addition the third, fourth, and fifth indicator positions are locked together 339 to show a special indicator symbol associated with the conditional reel modification.

In another embodiment, there is a bonus feature that is initiated by symbols on Reels 4 and 5. The only way for the Reel 5 symbol to appear is if the symbol appears on Reel 4, thus triggering a substitution in which the new Reel 5 reel strip contains the second initiator symbol.

In another embodiment, if one or more sets of conditions apply on the leftmost reels (e.g., Wild symbols appear on a played line on Reels 1 and 2) and if a random draw succeeds, then the remaining reels (e.g., Reels 3, 4, and 5) are transformed while they are still spinning.

In yet another embodiment, the reels do not necessarily stop in order from left to right. There may be a different order (for example, right-to-left) that applies every time the game is played, or the game may be such that the order changes with each spin. In the latter case, different reel strip changes may occur depending on which reels stop spinning first.

In other embodiments, high-value symbols are added to spinning reels, or low-value symbols removed, depending on the outcome of the first reel(s) to stop spinning.

In other embodiments, each new symbol created is a hybrid of the existing symbol and some alternative symbol. The new hybrid symbol substitutes for either the existing symbol or the alternative symbol when evaluating the window for pays. With this variant, the player may be ensured to be no worse off with the replacement symbols than with the originals.

Note that any of these variants may involve ghost/blank symbols being eliminated or replaced with non-ghost symbols. It is also possible for a reel strip to initially consist entirely of ghost symbols, some of which are replaced upon feature initiation. When this technique is used, it too may ensure that the player is no worse off with the replacement symbols than with the originals.

In all of these variants, more than one type of initiating symbol pattern is allowed. For example, the initial reel strips for a given game may have a white background, while the game could have two replacement sets of reel strips, one with a green background and another with a pink background. If, for example, a green scatter symbol is visible after the first reel stops, then the remaining reel strips are replaced with their corresponding green reel strips while those reels are still spinning. On the other hand, if a pink scatter symbol is visible after the first reel stops, then the pink reel strips are used.

In other embodiments, "overlays" can be used to modify reel strips or be used as trigger conditions for modification of subsequent reels. For example, a first reel outcome may be determined and the determined outcome shown on the game display (by, for example, spinning and stopping the reel to show the determined outcome). Based on a condition or at random, a symbol overlay can be implemented on one or more displayed symbols of the first reel. An overlay can be implemented by covering or replacing a displayed symbol, by adding an element to the displayed symbol—such as adding a subsymbol, adding an additional element to the symbol, etc., or by otherwise modifying the displayed symbol—such as by modifying the background, generating an animation, changing the size or position of a symbol element, etc. The overlay may be used to modify the outcome of the reel in which it appears (in the above example, modifying the outcome of the first reel) and/or be used to trigger a conditional change to a second reel.

In other embodiments, a pick mechanic may be used to allow a player to choose a modification mechanism for the second reel, or choose a replacement reel strip for the second reel. The type of modification or the content of the substitute reel strip may or may not be discoverable or visible by the player. That is, the pick mechanism may give the player a means to interact with the game and participate in the modification or substitution of the reel. The pick mechanism may be displayed in a secondary display area, dialog or menu box, or any other suitable display manner. The non-picked items may reveal a value that would have been awarded had they been selected, or may play no further part in the process.

FIGS. 4A, 4B, 4C, and 4D are diagrams of a game display showing another game progression using conditional reel functionality according to embodiments of the invention. Referring to FIGS. 4A-D, a game display 400 includes a game or display grid 410 showing portions of five game reels 412, 414, 416, 418, 420, a "Total Bet" meter 406 showing an amount wagered on a gaming event, a "Paid" meter 408 showing an amount won in gaming event, and a "SPIN" button 450 that allows a player to activate a gaming event.

Figure 4A:
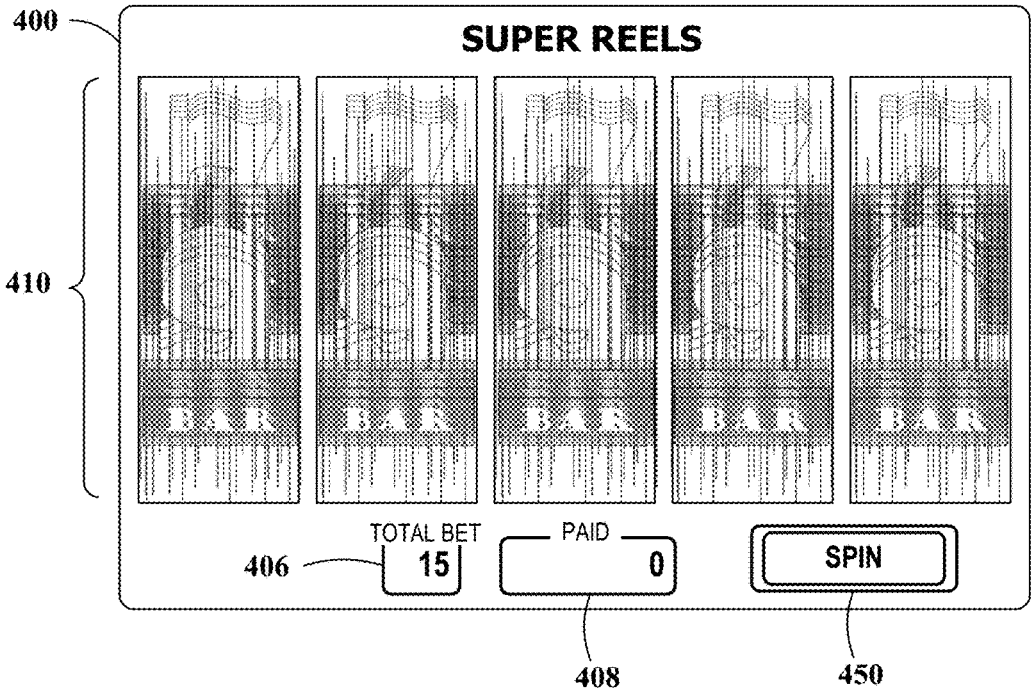
FIGS. 4A, 4B, 4C, and 4D are diagrams of a game display showing another game progression using conditional reel functionality according to embodiments of the invention.
Figure 4B:
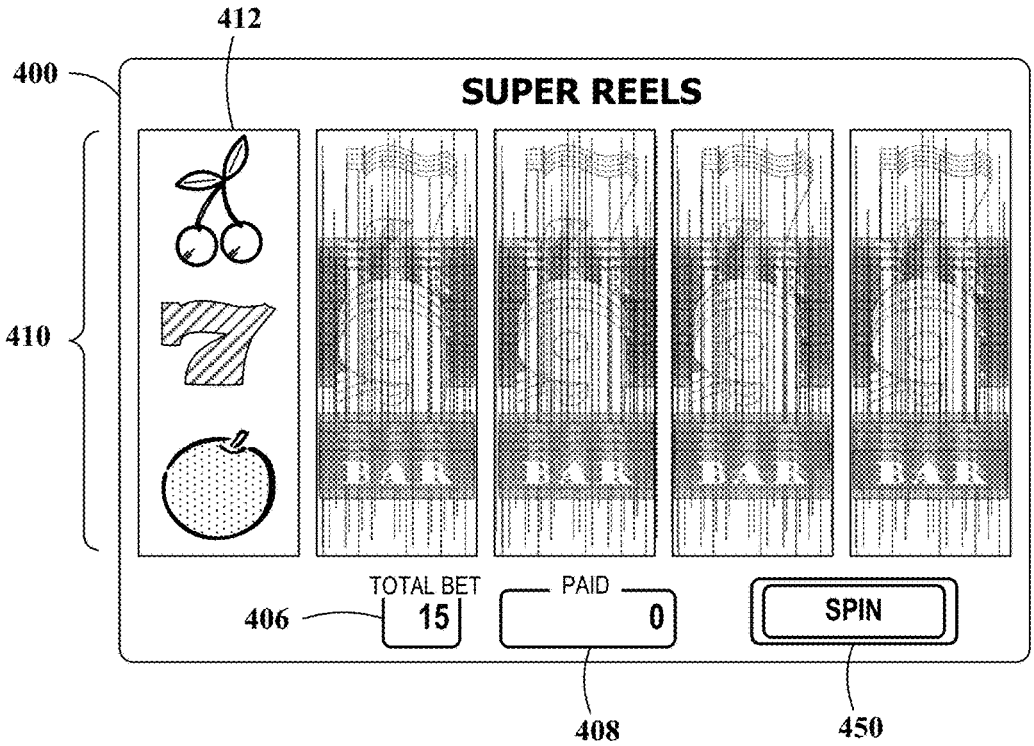
Figure 4C:
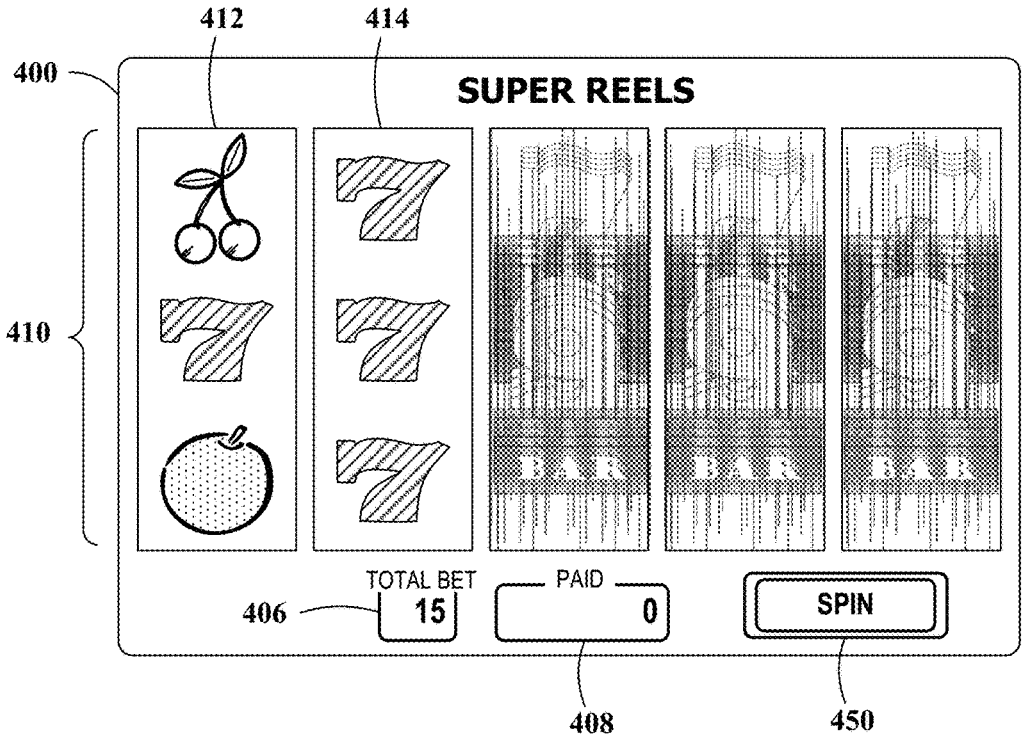
Figure 4D:
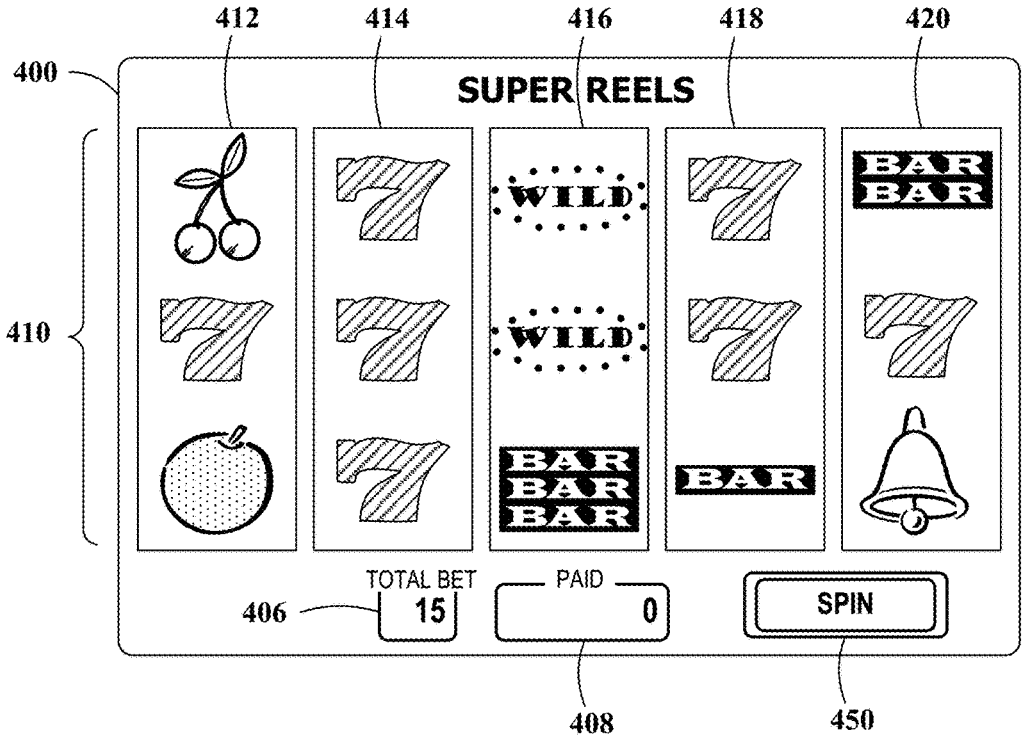

In FIG. 4A, a game event has been activated and each of the five reels are spinning through the game grid 410. In FIG. 4B, the first reel 412 comes to a stop showing a determined outcome for the first reel, which appears in the game grid 410. In FIG. 4C, the second reel 414 comes to a stop showing a determined outcome for the second reel, which also appears in the game grid 410. As discussed above, embodiments of this invention iteratively determine reel strips for some reels based on previously determined outcomes for other reels. In this embodiment, because a "Shaded-7" symbol has appeared in the game grid 410 for the first reel 412, the reel strip for the second reel is modified to include "stacks" or consecutive adjacent "Shaded-7" symbols, which increases the likelihood of a winning outcome on the game grid. This modification may be made by substituting a different reel strip for the second reel 414, may be made by expanding, adding, or inserting "Shaded-7" symbols to an existing reel strip associated with the second reel, or may be made by any of the other variations or embodiments discussed herein. In FIG. 4D, the third reel 416, fourth reel 418, and fifth reel 420 have all stopped as well showing a complete game event outcome on the game grid 410. The reel strip for the third reel 416 may have been modified based on the determined outcome for the second reel 414 and/or the determined outcome of the first reel 412. Likewise the fourth and fifth reels 418, 420 may have had their respective reel strips modified, substituted, or otherwise altered based on the previously determined outcomes for at least one of the other reels.

Although FIGS. 4A-D show the reels stopping left to right, in other embodiments, the reels may stop in any order. These other orders may also determine which reel strips are able to be modified. For example, if the fourth reel 418 stopped first and the third reel 416 stopped next, the reel strip for the third reel may be modified based on the determined outcome for the fourth reel. In some embodiments, all of the outcomes for the reels, including any modifications, substitutions, or alterations, are determined prior to showing any of the displayed outcomes. In other embodiments, reels may be iteratively modified, substituted, or altered after a previous outcome for a reel has been shown on the game grid 410.

Figure 5:
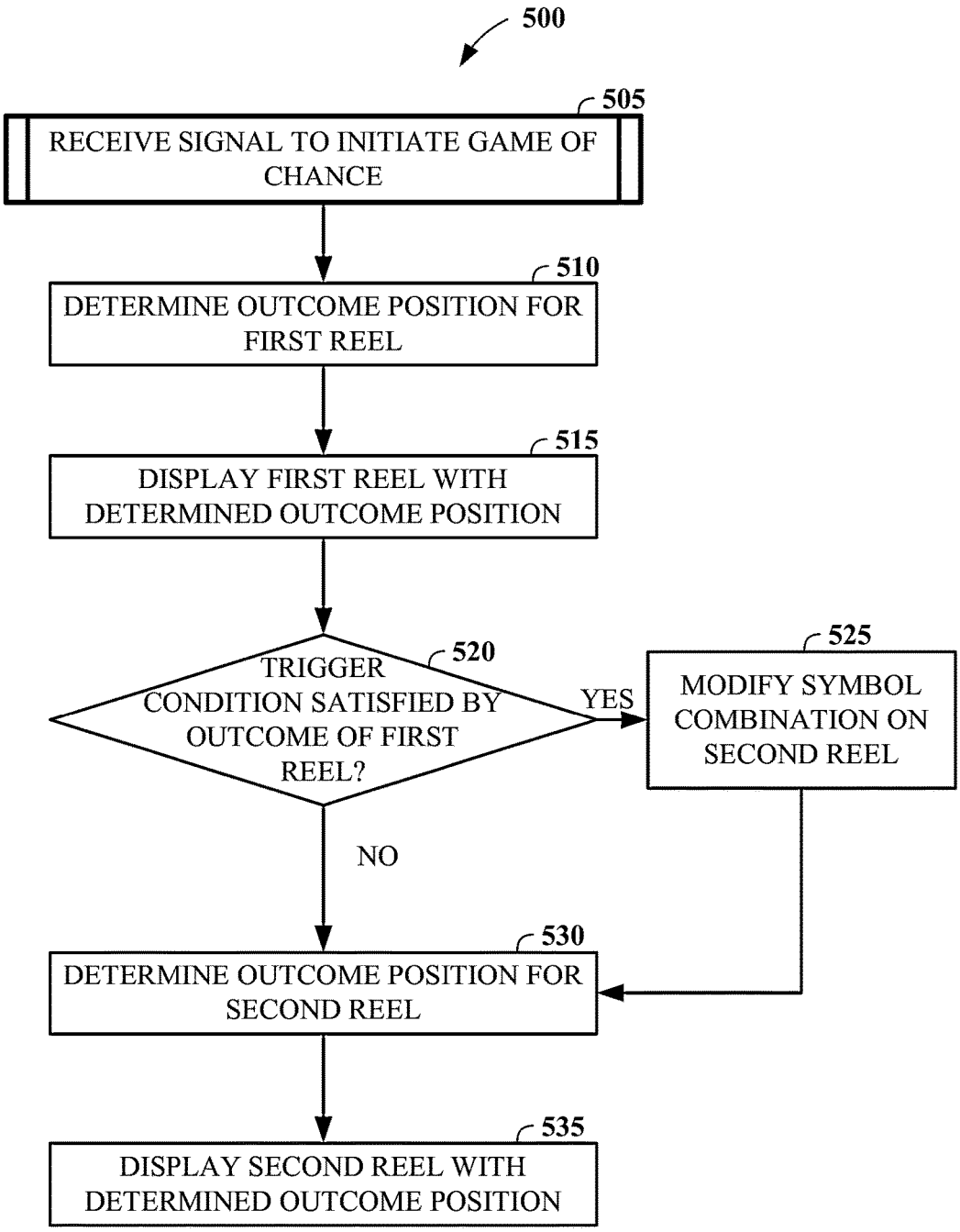
FIG. 5 is a flow diagram showing processes involved in providing a gaming event using conditional reel functionality according to embodiments of the invention.
Figure 6:
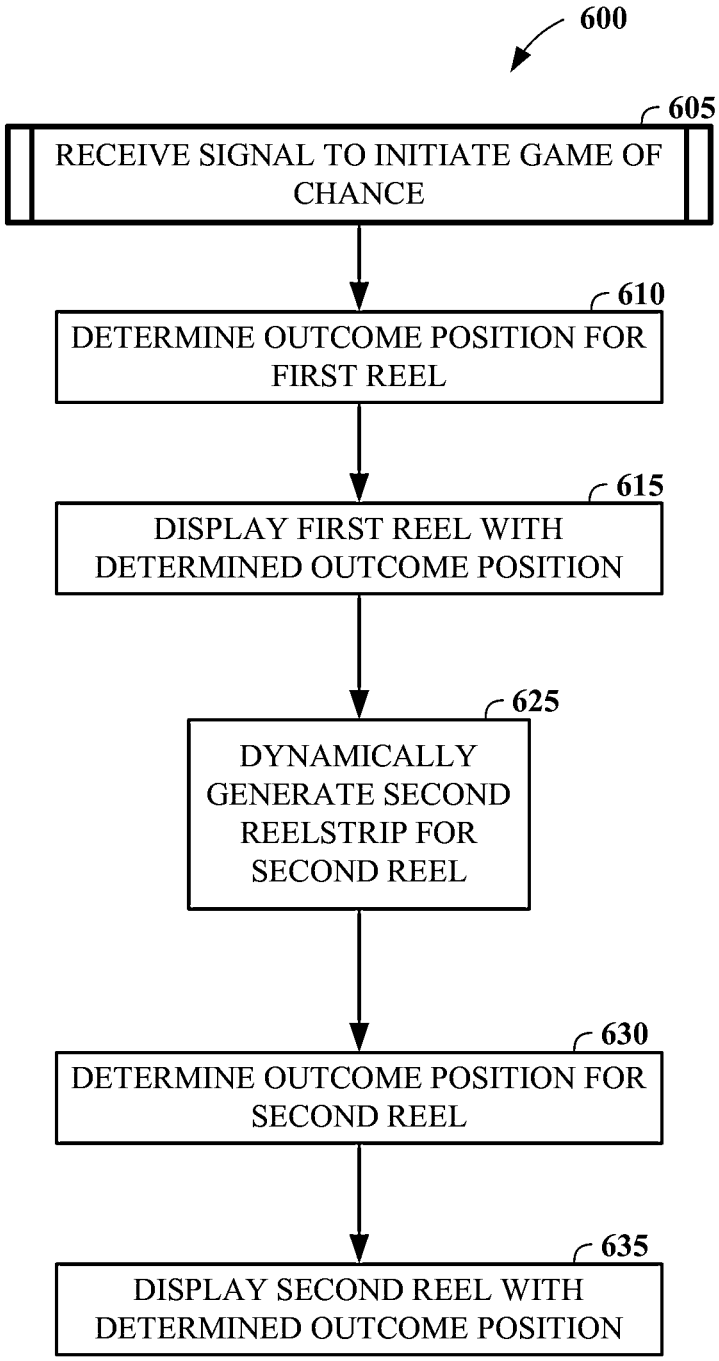
FIG. 6 is a flow diagram showing processes involved in providing another gaming event using conditional reel functionality according to embodiments of the invention.

FIGS. 5 and 6 are flow diagrams showing processes involved in providing a gaming event using conditional reel functionality according to embodiments of the invention. Although various processes are shown in a particular order in these flow diagrams, the order of these processes can be changed in other embodiments without deviating from the scope or spirit of this concept. Hence, the order of the processes shown is for illustrative purposes only and is not meant to be restrictive. Additional game processes may also be included between various processes even though they are not shown in these flow diagrams for clarity purposes. Further, each of the processes may be performed by components in a single game device, such as by a game processor, or may be performed in part or whole by a remote server or processor connected to the gaming device via a network. Each process may be encoded in instructions that are stored in a memory, a computer-readable medium, or another type of storage device.

Referring to FIG. 5, flow 500 begins at process 505 where a signal is received to initiate a game of chance or game event. In process 510, an outcome position is determined for a first reel. A "first" reel may be the leftmost reel, or any reel on a display. The outcome position may be determined in process 510 by randomly selecting a reel stop associated with the first reel. For example, if a reel strip associated with the first reel included 50 positions or reel stops, a random number between 1 and 50 may be determined where that position is associated with a middle (or other position) in a display grid on a game display. In process 515, the first reel is displayed such that the determined outcome position is shown on the game display. For example, the first reel may be stopped from spinning so that the symbol associated with the outcome position is shown on the display grid.

In process 520, it is determined if a trigger condition is satisfied by the outcome of the first reel. In some embodiments the trigger condition may relate to the specific symbols associated with the determined outcome of the first reel that are shown in the game grid, while in other embodiments, the trigger condition may include other aspects related to the first reel, such as whether the reel was "slammed" to a stop by a player or allowed to stop on its own, whether a particular symbol on reel 1 did not come up, or whether a particular symbol on reel 1 has not come up for a predetermined number of games.

If the trigger condition is not satisfied, flow 500 proceeds to process 530 where an outcome position for a second reel is determined. If a trigger condition is satisfied in process 520, flow 500 proceeds to process 525 where a symbol combination on the second reel is modified. As discussed above, the symbol combination on the second reel can be modified in a variety of ways in different embodiments. After the second reel has been modified in process 525, flow 500 proceeds to process 530 where the outcome position for the second reel, as modified, is determined. In process 535, the determined outcome position for the second reel is then shown on the game display. For example, the second reel may be stopped from spinning so that the symbol associated with the outcome position is shown on the display grid.

Although this example flow 500 illustrates displaying the determined outcome position of the first reel prior to determining the outcome position of the second reel, the outcome positions of all reels may be determined prior to displaying any of the game outcomes, or even determined prior to initially spinning the reels.

Additionally, as discussed above, one or more remaining reels may also be conditionally modified by iteratively applying processes 520, 525, 530, and 535 to these remaining reels. Here, for example, the trigger condition determination in process 520 may consider characteristics of all previously determined reels, or may only consider characteristics of an immediately prior reel outcome.

Referring to FIG. 6, flow 600 begins at process 605 where a signal is received to initiate a game of chance or game event. In process 610, an outcome position is determined for a first reel. A "first" reel may be the leftmost reel, or any reel on a game display. The outcome position may be determined in process 610 by a randomly selected reel stop associated with the first reel. For example, if a reel strip associated with the first reel included 50 positions or reel stops, a random number between 1 and 50 may be determined where that position is associated with a middle (or other position) in a display grid on a game display. In process 615, the first reel is displayed such that the determined outcome position is shown on the game display. For example, the first reel may be stopped from spinning so that the symbol associated with the outcome position is shown on the display grid.

In process 625, the combination of symbols used for the second reel strip on the second reel is dynamically generated based on the determined outcome position of the first reel. Here, the conditional reel functionality may include dynamically generating the second reel strip (and/or other reel strips) based on the outcome determined for the first reel strip. In some embodiments, a weighted table is used to select the symbols for the symbol combination forming the second reel strip. Here, the weights in the weighted table may be changed depending on the determined outcome of the first reel. In some of these embodiments, and in other embodiments, one or more rules may also be used in dynamically generating the reel combination for the second reel strip. Some example rules may include: 1) No two bonus symbols may be adjacent to each other; 2) No two jackpot symbols may be within five positions of each other; or 3) Whatever symbol is chosen for position "X" (e.g., position 7), that symbol is automatically repeated at positions "X+1," "X+2," "X+3," "X+4," and "X+5," (in the above example, at positions 8, 9, 10, 11, and 12).

After the second reel strip has been dynamically generated in process 625 for the second reel, flow 600 proceeds to process 630 where the outcome position for the second reel, as generated, is determined. In process 635, the determined outcome position for the second reel is then shown on the game display. For example, the second reel may be stopped from spinning so that the symbol associated with the outcome position is shown on the display grid.

Although this example flow 600 illustrates displaying the determined outcome position of the first reel prior to determining the outcome position of the second reel, the outcome positions of all reels may be determined prior to displaying any of the game outcomes, or even determined prior to initially spinning the reels. Additionally, as discussed above, one or more remaining reels may also be dynamically generated by iteratively applying processes 625, 630, and 635 to these remaining reels. In other embodiments, an additional process similar to process 520 may be implemented prior to process 625 to determine if a second reel should be dynamically generated based on the characteristics of the determined outcome of the first reel. If it is determined that the characteristics of the first reel do not satisfy a trigger condition, a predetermined default reel strip may be used for the second (and subsequent) reels. Alternatively, a default reel strip may be modified or replaced with another predefined reel strip as described above with respect to FIG. 5.

Note that these example methods are just some embodiments of how a game operation can be implemented. As discussed and shown above, many variations exist which may require additional, fewer, or different processes to complete.

FIGS. 7, 8A, 8B, and 9 are diagrams representative of example reel strips used in conjunction with providing conditional reel functionality in a gaming device according to embodiments of the invention. Reel strips may be implemented in mechanical slot devices where images are printed on physical strips of material that are affixed to mechanical reels, or where images are projected onto or shown above physical reels. In video embodiments, reel strips may be implemented virtually where the strips include video generated images of symbols that are arranged in a particular order according to instructions stored in a memory of a gaming device. These diagrams provide some examples of how conditional reel functionality can be implemented in some embodiments. However, many variations exist that fall within the scope and breadth of this invention.

Figure 7:
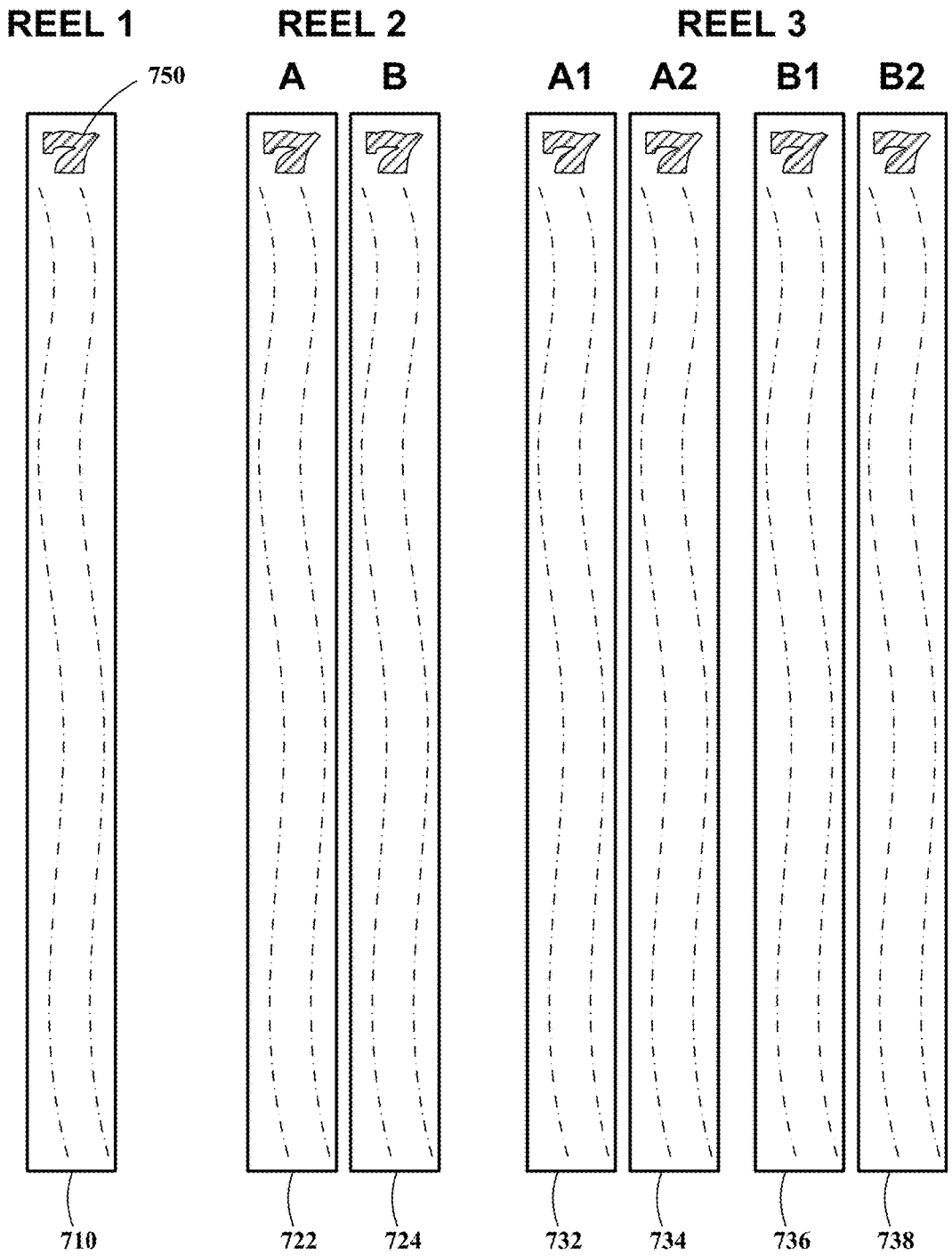
FIG. 7 is a diagram representative of example reel strips used in conjunction with providing conditional reel functionality in a gaming device according to embodiments of the invention.

Referring to FIG. 7, reel strips are shown for a three reel gaming device (not shown). Each of these reel strips include multiple symbols 750 that are arranged in a predefined order. In this embodiment a single reel strip 710 is associated with reel 1, two reel strips 722, 724 are associated with reel 2, and four reel strips 732, 734, 736, 738 are associated with reel 3. In operation during a gaming event, reels 1, 2, and 3 are spun. The single reel strip 710 is used for reel 1 and an outcome for reel 1 is determined. This outcome may be displayed by stopping reel 1 from spinning to a position associated with the determined outcome. Based on the determined outcome of reel 1, reel strip "A" 722 or reel strip "B" 724 may be used for reel 2. In some embodiments, reel strip "A" is a default reel strip that is used for reel 2 unless otherwise directed. In these embodiments, reel strip "B" may include more "wilds," "bonus symbols," streaks of adjacent identical symbols, or other features that increase the chance of a high paying or exciting game event outcome. As described above, if a substitute reel strip is implemented on a reel after a reel has already started spinning, the new reel strip can be "sewn" into the spin to mask the transition the new strip, or can immediately replace the current strip with animation, sounds, or other interactive items to alert a player of the change.

Based on the determined outcome of reel 2 and/or the determined outcome of reel 1, reel strip "A1" 732, reel strip "A2" 734, reel strip "B1" 736, or reel strip "B2" 738 may be used for reel 3. In some embodiments, reel strip "A1" 732 or reel strip "A2" 734 may be used when reel strip "A" 722 is used for the second reel, and reel strip "B1" 736 or reel strip "B2" 738 may be used when reel strip "B" is used for the second reel. In other embodiments, any possible reel strip may be available for use on reel 3 regardless of which reel strip is used with reel 2. In these other embodiments, the reel strip for use with reel 3 may be dependent on the outcome(s) of reel 2 and/or reel 1, or on other triggering conditions.

Although two reel strips are shown for possible reel strips for reel 2, and four reel strips are shown as possible reel strips for reel 4, more or fewer reel strips may be used for each reel. In some embodiments, some of the reels may not have multiple possible reel strips (i.e., the same reel strip will be used each time, even if it is a reel whose outcome is determined later than the outcome of another reel). Even reel 1 may have multiple possible reel strips, which may be selected based on a random determination, a weighted table, a wager amount, a side wager, a player loyalty club status, prior game event results, or other conditions. In other embodiments, where the reels are stopped in a different order, the number of reel strips associated with each reel may change.

Figures 8A, 8B:
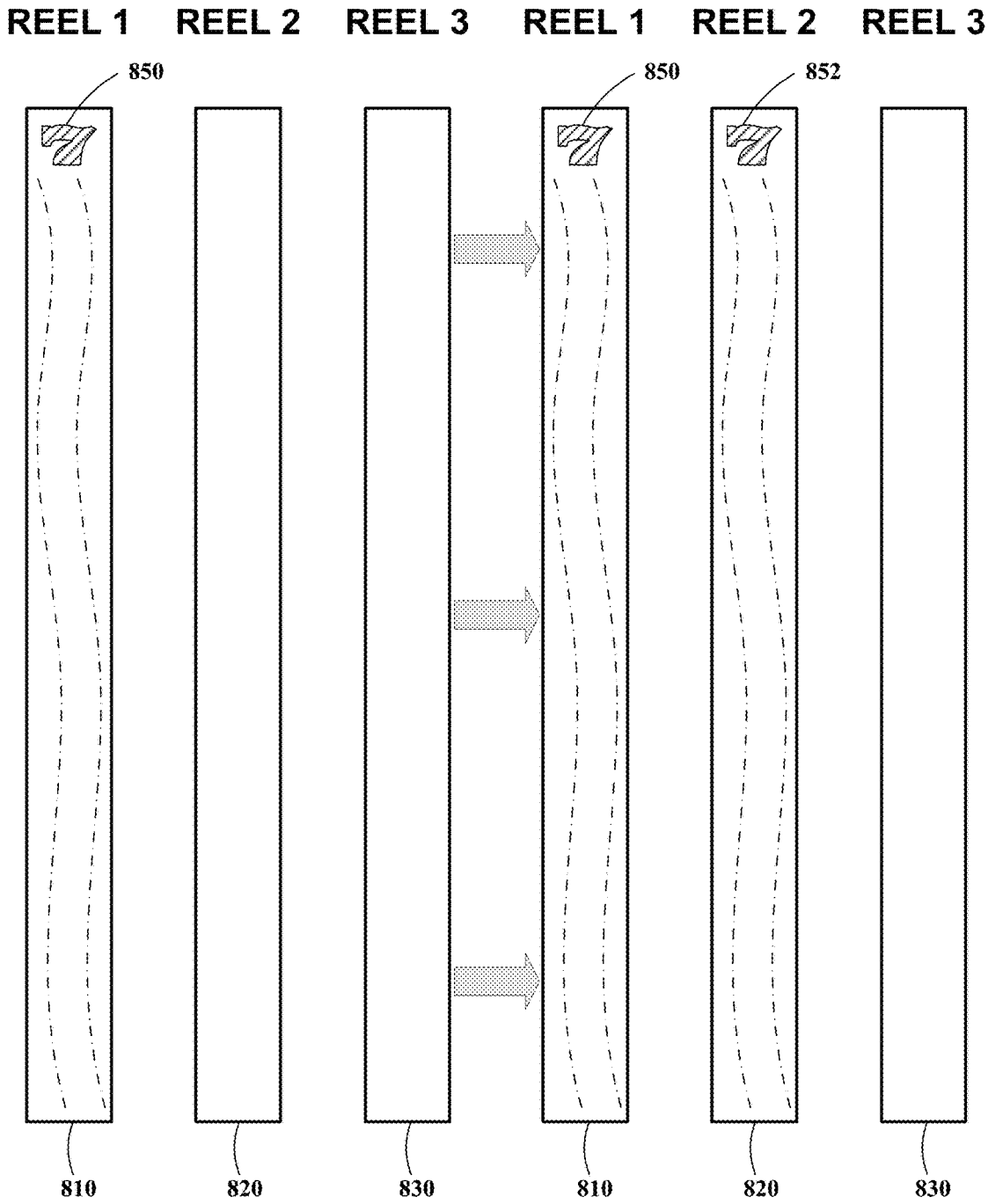
FIGS. 8A and 8B are diagrams representative of other example reel strips used in conjunction with providing conditional reel functionality in a gaming device according to embodiments of the invention.

Referring to FIG. 8A, each of reels 1, 2, and 3, are associated with a single reel strip 810, 820, 830, respectively. However, in this embodiment, only the reel strip 810 associated with the first reel is set with symbols 850 in a predefined order. The reel strip 820 associated with second reel, and the reel strip 830 associated with the third reel are initially filled with blank or ghost symbols at each symbol position. Once a gaming event has been initiated, and an outcome for the first reel is determined, symbols 852 are selected to dynamically generate a symbol order on the second reel strip 820, as shown in FIG. 8B. As discussed above with respect to FIG. 6, this dynamic generation of symbol order may be based on the outcome of reel 1, or may be based on the outcome of reel 1 and one or more other predefined rules. Although not shown, a symbol combination may also be dynamically generated for the reel strip 830 associated with reel three based on the outcome of the second reel and/or the outcome of the first reel.

In operation, the reel strips 820, 830 associated with the second and third reel may be visually spun as blank reels, a default or dummy set of symbols may be used for the spin animation, or another visual effect may be used during game events where the second and third reel are being spun prior to the outcome of reel 1 being shown. In one example, reels 2 and 3 are initially spun as blank reels. When reel 1 stops and an outcome is shown, reel two becomes populated with symbols while spinning, while reel 3 is still blank. After reel 2 stops and an outcome is shown, reel 3 is populated with symbols while spinning before stopping to show an outcome. In another example, the outcomes for reels 1, 2, and 3 are all determined (even with the dynamic generation for reels 2 and 3) prior to spinning any of the reels. Here, the actually determined reel strips for reels 2 and 3 may be used during the visual spin of the reels.

Figure 9:
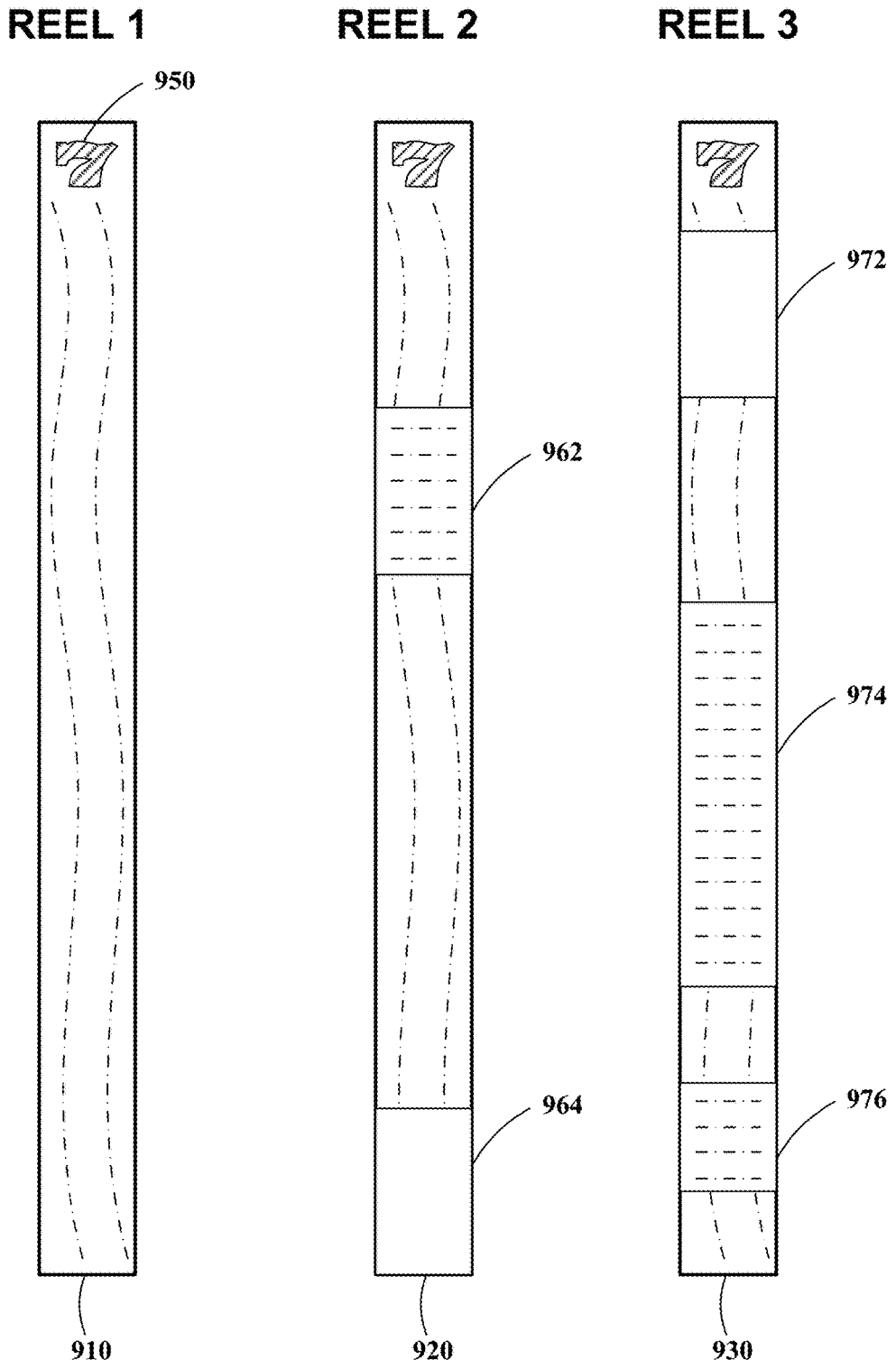
FIG. 9 is a diagram representative of yet other example reel strips used in conjunction with providing conditional reel functionality in a gaming device according to embodiments of the invention.

Referring to FIG. 9, each of reels 1, 2, and 3, are associated with a single reel strip 910, 920, 930, respectively. In this embodiment, however, the reel strips 920, 930 associated with the second and third reel, have open spaces 962, 964, 972, 974, 976 among set symbols 950 where they can be conditionally modified based on the outcomes of one or more of the previous reels. As shown in spaces 962, 974, 976, these spaces may have default symbols associated with the "open" spaces that can be replaced when indicated, or as shown in spaces 964, 972, these spaces may have blank or ghost positions that can be filled when indicated, or contracted to shorten the reel strip when indicated. As discussed above, there are many ways to modify reel strips based on one or more previously determined outcome from one or more other reel strips.

Figure 10:
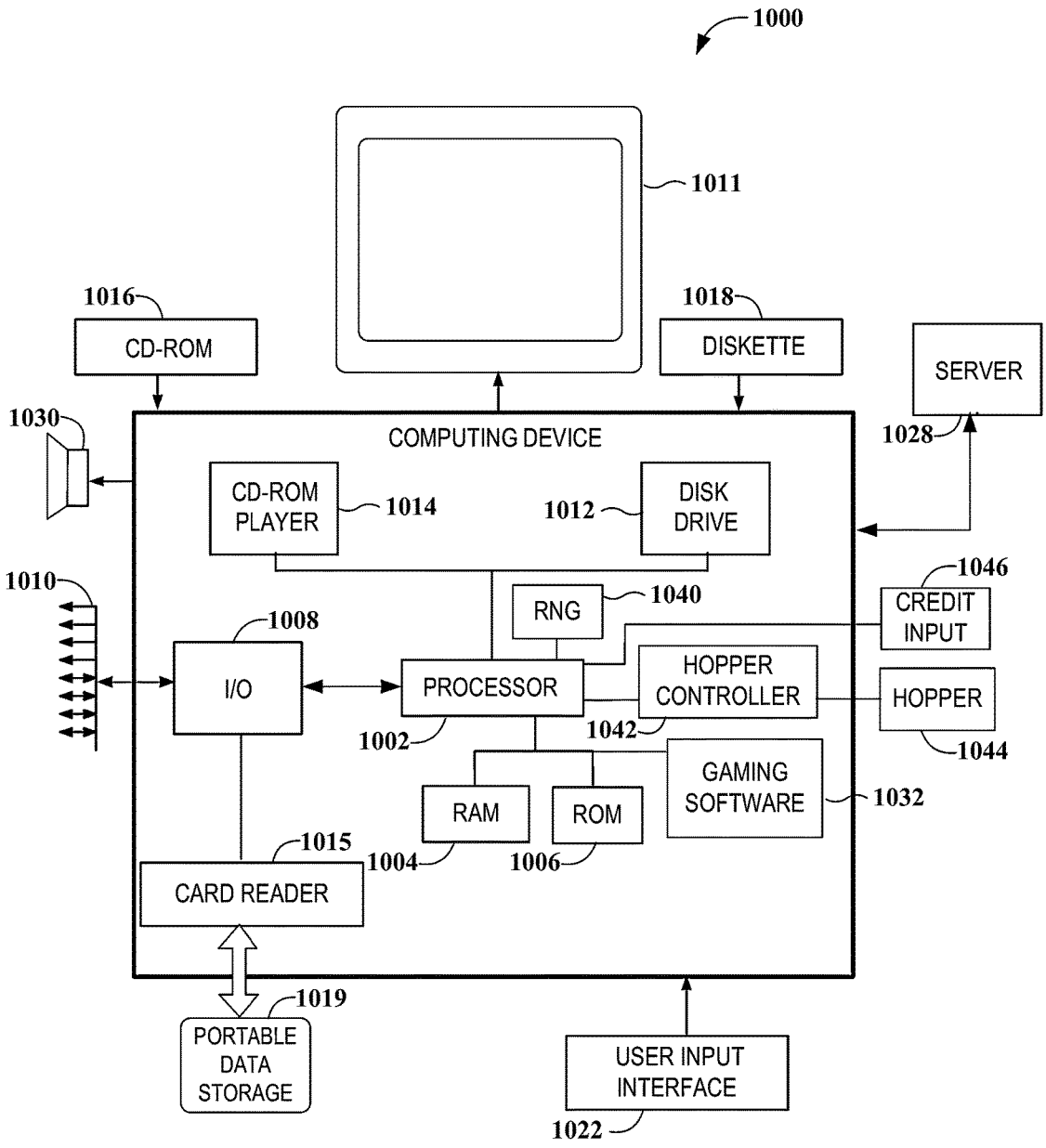
FIG. 10 is a block diagram illustrating a computing arrangement according to embodiments of the invention.

As may now be readily understood, one or more devices may be programmed to play various embodiments of the invention. The present invention may be implemented as a casino gaming machine or other special purpose gaming kiosk as described hereinabove, or may be implemented via computing systems operating under the direction of local gaming software, and/or remotely-provided software such as provided by an application service provider (ASP). The casino gaming machines utilize computing systems to control and manage the gaming activity. An example of a representative computing system capable of carrying out operations in accordance with the invention is illustrated in FIG. 10.

Hardware, firmware, software or a combination thereof may be used to perform the various gaming functions, display presentations and operations described herein. The functional modules used in connection with the invention may reside in a gaming machine as described, or may alternatively reside on a stand-alone or networked computer. The computing structure 1000 of FIG. 10 is an example computing structure that can be used in connection with such electronic gaming machines, computers, or other computer-implemented devices to carry out operations of the present invention.

The example computing arrangement 1000 suitable for performing the gaming functions in accordance with the present invention typically includes a central processor (CPU) 1002 coupled to random access memory (RAM) 1004 and some variation of read-only memory (ROM) 1006. The ROM 1006 may also represent other types of storage media to store programs, such as programmable ROM (PROM), erasable PROM (EPROM), etc. The processor 1002 may communicate with other internal and external components through input/output (I/O) circuitry 1008 and bussing 1010, to provide control signals, communication signals, and the like.

The computing arrangement 1000 may also include one or more data storage devices, including hard and floppy disk drives 1012, CD-ROM drives 1014, card reader 1015, and other hardware capable of reading and/or storing information such as DVD, etc. In one embodiment, software for carrying out the operations in accordance with the present invention may be stored and distributed on a CD-ROM 1016, diskette 1018, access card 1019, or other form of computer readable media capable of portably storing information. These storage media may be inserted into, and read by, devices such as the CD-ROM drive 1014, the disk drive 1012, card reader 1015, etc. The software may also be transmitted to the computing arrangement 1000 via data signals, such as being downloaded electronically via a network, such as the Internet. Further, as previously described, the software for carrying out the functions associated with the present invention may alternatively be stored in internal memory/storage of the computing device 1000, such as in the ROM 1006.

The computing arrangement 1000 is coupled to the display 1011, which represents a display on which the gaming activities in accordance with the invention are presented. The display 1011 represents the "presentation" of the video information in accordance with the invention, and may be any type of known display or presentation screen, such as liquid crystal displays, plasma displays, cathode ray tubes (CRT), digital light processing (DLP) displays, liquid crystal on silicon (LCOS) displays, etc.

Where the computing device 1000 represents a standalone or networked computer, the display 1011 may represent a standard computer terminal or display capable of displaying multiple windows, frames, etc. Where the computing device is embedded within an electronic gaming machine, the display 1011 corresponds to the display screen of the gaming machine/kiosk. A user input interface 1022 such as a mouse, keyboard/keypad, microphone, touch pad, trackball, joystick, touch screen, voice-recognition system, etc. may be provided. The display 1011 may also act as a user input device, e.g., where the display 1011 is a touch-screen device. In embodiments, where the computing device 1000 is implemented in a personal computer, tablet, smart phone, or other consumer electronic device, the user interface and display may be the available input/output mechanisms related to those devices.

Chance-based gaming systems such as slot machines, in which the present invention is applicable, are governed by random numbers and processors, as facilitated by a random number generator (RNG). The fixed and dynamic symbols generated as part of a gaming activity may be produced using one or more RNGs. RNGs as known in the art may be implemented using hardware, software operable in connection with the processor 1002, or some combination of hardware and software. The present invention is operable using any known RNG, and may be integrally programmed as part of the processor 1002 operation, or alternatively may be a separate RNG controller 1040. The RNGs are often protected by one or more security measures to prevent tampering, such as by using secured circuitry, locks on the physical game cabinet, and/or remote circuitry that transmits data to the gaming device.

The computing arrangement 1000 may be connected to other computing devices or gaming machines, such as via a network. The computing arrangement 1000 may be connected to a network server 1028 in an intranet or local network configuration. The computer may further be part of a larger network configuration as in a global area network (GAN) such as the Internet. In such a case, the computer may have access to one or more web servers via the Internet. In other arrangements, the computing arrangement 1000 may be configured as an Internet server and software for carrying out the operations in accordance with the present invention may interact with the player via one or more networks. The computing arrangement 1000 may also be operable over a social network or other network environment that may or may not regulate the wagering and/or gaming activity associated with gaming events played on the computing arrangement.

Other components directed to gaming machine implementations include manners of gaming participant payment, and gaming machine payout. For example, a gaming machine including the computing arrangement 1000 may also include a hopper controller 1042 to determine the amount of payout to be provided to the participant. The hopper controller may be integrally implemented with the processor 1002, or alternatively as a separate hopper controller 1042. A hopper 1044 may also be provided in gaming machine embodiments, where the hopper serves as the mechanism holding the coins/tokens of the machine. The wager input module 1046 represents any mechanism for accepting coins, tokens, coupons, bills, electronic fund transfer (EFT), tickets, credit cards, smart cards, membership/loyalty cards, etc., for which a participant inputs a wager amount. It will be appreciated that the primary gaming software 1032 may be able to control payouts via the hopper 1044 and controller 1042 for independently determined payout events.

Among other functions, the computing arrangement 1000 provides an interactive experience to players via input interface 1022 and output devices, such as the display 1011, speaker 1030, etc. These experiences are generally controlled by gaming software 1032 that controls a primary gaming activity of the computing arrangement 1000. The gaming software 1032 may be temporarily loaded into RAM 1004, and may be stored locally using any combination of ROM 1006, drives 1012, media player 1014, or other computer-readable storage media known in the art. The primary gaming software 1032 may also be accessed remotely, such as via the server 1028 or the Internet.

The primary gaming software 1032 in the computing arrangement 1000 is shown here as an application software module. According to embodiments of the present invention, this software 1032 provides a slot game or similar game of chance as described hereinabove. For example, the software 1032 may present, by way of the display 1011, representations of symbols to map or otherwise display as part of a slot based game having reels. However, in other embodiments, the principles of this concept may be applied to poker games or other types of games of chance. One or more aligned positions of these game elements may be evaluated to determine awards based on a paytable. The software 1032 may include instructions to provide other functionality as known in the art and described herein, such as shown and described above regarding FIGS. 1-9.

The foregoing description of the exemplary embodiments has been presented for the purposes of illustration and description. It is not intended to be exhaustive or to limit the invention to the precise form disclosed. Many modifications and variations are possible in light of the above teaching. For example, the present invention is equally applicable in electronic or mechanical gaming machines, and is also applicable to live table versions of gaming activities that are capable of being played in a table version (e.g., machines involving poker or card games that could be played via table games).

Some embodiments of the invention have been described above, and in addition, some specific details are shown for purposes of illustrating the inventive principles. However, numerous other arrangements may be devised in accordance with the inventive principles of this patent disclosure. Further, well known processes have not been described in detail in order not to obscure the invention. Thus, while the invention is described in conjunction with the specific embodiments illustrated in the drawings, it is not limited to these embodiments or drawings. Rather, the invention is intended to cover alternatives, modifications, and equivalents that come within the scope and spirit of the inventive principles set out in the appended claims.

The invention claimed is:

1. A gaming device comprising:

a video display device having a game play area including:

a grid having a plurality of symbol positions, and an indicator grid having a plurality of indicator positions;

a player interface including at least one button, the button configured to generate a signal in response to being activated;

a wager input device structured to receive physical items associated with currency values;

a memory configured to store a credit amount and store data related to a first game reel, a second game reel, and a third game reel, wherein the first game reel includes a first combination of game symbols, the second game reel includes a second combination of game symbols, and the third game reel includes a third combination of game symbols; and game circuitry operable to:

receive a signal from the wager input device indicating receipt of a physical item associated with a currency value;

increase the credit amount stored in the memory based on the currency value associated with the received physical item;

receive a wager on a game event, the wager decreasing the credit amount stored in the memory, spin the first game reel, the second game reel, and the third game reel through the grid of symbol positions, determine a first outcome for the first game reel, stop the first game reel to display the determined first outcome for the first game reel in the grid of symbol positions, determine when a trigger condition is satisfied by the first outcome, display a special indicator symbol in an indicator position of the indicator grid corresponding to the first game reel when the trigger condition is satisfied by the first outcome, modify the second combination of game symbols on the second game reel to generate a fourth combination of game symbols when the trigger condition is satisfied by the first outcome, determine a second outcome for the second game reel using the fourth combination of game symbols, stop the second game reel to display the determined second outcome for the second game reel in the grid of symbol positions and;

increase the credit amount stored in the memory based on any awards associated with the game event.

2. The gaming device of claim 1, wherein the game circuitry is further operable to:

determine a third outcome for the third game reel;

stop the third game reel to display the determined third outcome for the third game reel in the grid of symbol positions; and evaluate the first outcome, second outcome, and third outcome of the grid to determine awards.

3. The gaming device of claim 2, wherein the game circuitry is further operable to:

determine if a trigger condition is satisfied by the second outcome; and modify the third combination of game symbols on the third game reel to generate a fifth combination of game symbols when the trigger condition is satisfied by the second outcome;

wherein the third outcome for the third game reel is determined using the fifth combination of game symbols on the third reel.

4. The gaming device of claim 1, wherein the triggering condition is satisfied by the first outcome when identical symbols appear in each symbol position of a first column of the grid when the first reel is stopped.

5. The gaming device of claim 4, wherein the game circuitry is operable to modify the second combination of game symbols on the second game reel to generate a fourth combination of game symbols by inserting at least one extra symbol corresponding to the identical symbols in the first column of the grid in the second game reel.

6. The gaming device of claim 1, wherein the game circuitry is further operable to lock the second reel and third reel together when the trigger condition is satisfied by the first outcome.

7. The gaming device of claim 6, wherein the game circuitry is further operable to modify the third combination of game symbols on the third game reel to generate a fifth combination of game symbols when the trigger condition is satisfied by the first outcome.

8. The gaming device of claim 7, wherein the game circuitry is operable to generate the fourth combination of symbols and the fifth combination of symbols on the locked second game reel and third game reel by including at least one block symbol covering both the second game reel and third game reel.

9. The gaming device of claim 8, wherein a symbol shown in the at least one block symbol is based on the first outcome shown on the grid.

10. The gaming device of claim 1, wherein the game circuitry is further operable to display a strike symbol in an indicator position of the indicator grid corresponding to the first game reel when the trigger condition is not satisfied by the first outcome.

11. A gaming device comprising:

a video display having a grid of symbol positions to display game events;

a player input device configured to receive inputs from a player;

a memory configured to store a credit amount and store data related to a first game reel, a second game reel, a third game reel, and a table of symbols, wherein the first game reel includes a first combination of game symbols;

a wager input device structured to receive physical items associated with currency values; and a processor configured to:

receive a signal from the wager input device indicating receipt of a physical item associated with a currency value;

increase the credit amount stored in the memory based on the currency value associated with the received physical item;

receive a wager on a game event, the wager decreasing the credit amount stored in the memory, spin the first game reel, the second game reel, and the third game reel through the grid of symbol positions, determine a first outcome for the first game reel, stop the first game reel to display the determined first outcome for the first game reel in the grid of symbol positions, dynamically determine a second combination of symbols for the second game reel, using the table of symbols, based on the first outcome, determine a second outcome for the second game reel using the second combination of game symbols, stop the second game reel to display the determined second outcome for the second game reel in the grid of symbol positions, and increase the credit amount stored in the memory based on any awards associated with the game event.

12. The gaming device of claim 11, wherein the processor is further configured to:

dynamically determine a third combination of symbols for the third game reel, using the table of symbols, based on the first outcome, determine a third outcome for the third game reel using the third combination of game symbols, stop the third game reel to display the determined third outcome for the third game reel in the grid of symbol positions, and evaluate the first outcome, second outcome, and third outcome in the grid of symbol positions to determine awards.

13. The gaming device of claim 11, wherein the processor is further configured to:

dynamically determine a third combination of symbols for the third game reel, using the table of symbols, based on the second outcome, determine a third outcome for the third game reel using the third combination of game symbols, stop the third game reel to display the determined third outcome for the third game reel in the grid of symbol positions, and evaluate the first outcome, second outcome, and third outcome in the grid of symbol positions to determine awards.

14. The gaming device of claim 11, wherein the processor is configured to dynamically determine the second combination of symbols for the second game reel by:

adjusting weights associated with each symbol in the table of symbols; and randomly selecting the symbols from the table of symbols with adjusted weights.

15. The gaming device of claim 11, wherein the memory further stores data related to a set of rules.

16. The gaming device of claim 15, wherein the processor is configured to dynamically determine the second combination of symbols for the second game reel by:

randomly selecting a first symbol from the table of symbols for a first symbol position on the second reel, randomly selecting a second symbol from the table of symbols for a second symbol position on the second reel, determining if the second symbol satisfies the set of rules in relation to the first symbol, and repeating the random selection of a second symbol until the selected second symbol satisfies the set of rules in relation to the first symbol.

17. The gaming device of claim 15, wherein the processor is configured to dynamically determine the second combination of symbols for the second game reel by:

randomly selecting a plurality of symbols from the table of symbols; and arranging the randomly selected symbols, using the set of rules, to determine the second combination of symbols for the second game reel.

18. A gaming device comprising:

a video display device having a grid of symbol positions;

a player interface including at least one button, the button configured to generate a signal in response to being activated;

a wager input device structured to receive physical items associated with currency values;

a memory configured to store a credit amount and store data related to a first symbol combination associated with a first game reel, a second symbol combination associated with a second game reel, a third symbol combination associated with the second game reel, and a fourth symbol combination associated with a third game reel; and game circuitry operable to:

receive a signal from the wager input device indicating receipt of a physical item associated with a currency value;

increase the credit amount stored in the memory based on the currency value associated with the received physical item;

receive a wager on a game event, the wager decreasing the credit amount stored in the memory, spin the first game reel, the second game reel, and the third game reel through the grid of symbol positions, determine a first outcome for the first game reel, stop the first game reel to display the determined first outcome for the first game reel in the grid of symbol positions, determine when the second symbol combination or the third symbol combination is to be used on the second game reel based on the first outcome, implement the determined one of the second symbol combination or the third symbol combination on the second game reel, determine a second outcome for the second game reel using the determined one of the second symbol combination or the third symbol combination, stop the second game reel to display the determined second outcome for the second game reel in the grid of symbol positions, and increase the credit amount stored in the memory based on any awards associated with the game event.

19. The gaming device of claim 18, wherein the memory further stores a fifth symbol combination associated with a third game reel, and wherein the game circuitry is further operable to:

determine if the fourth symbol combination or the fifth symbol combination is to be used on the third game reel based on the first outcome;

implement the determined one of the fourth symbol combination or the fifth symbol combination on the third game reel;

determine a third outcome for the third game reel using the determined one of the fourth symbol combination or the fifth symbol combination;

stop the third game reel to display the determined third outcome for the third game reel in the grid of symbol positions; and evaluate the first outcome, second outcome, and third outcome in the grid of symbol positions to determine awards.

20. The gaming device of claim 18, wherein the memory further stores a fifth symbol combination associated with a third game reel, a sixth symbol combination associated with a third game reel, a seventh symbol combination associated with a third game reel, and wherein the game circuitry is further operable to:

determine if the fourth symbol combination or the fifth symbol combination is to be used on the third game reel based on the second outcome when the second symbol combination is implemented on the second reel;

determine if the sixth symbol combination or the seventh symbol combination is to be used on the third game reel based on the second outcome when the third symbol combination is implemented on the second reel;

implement the determined one of the fourth symbol combination, the fifth symbol combination, the sixth symbol combination, or the seventh symbol combination on the third game reel;

determine a third outcome for the third game reel using the determined one of the fourth symbol combination, the fifth symbol combination, the sixth symbol combination, or the seventh symbol combination;

stop the third game reel to display the determined third outcome for the third game reel in the grid of symbol positions; and evaluate the first outcome, second outcome, and third outcome in the grid of symbol positions to determine awards.

* * * * *